US012716407B2

(12) United States Patent
Dimitrov

(10) Patent No.: US 12,716,407 B2
(45) Date of Patent: Aug. 25, 2026

(54) PUMP COMPRISING A PRESSURE CHAMBER AND A COOLING SYSTEM

(71) Applicant: KNF Neuberger GmbH, Freiburg (DE)

(72) Inventor: Martin Dimitrov, Bad Krozingen (DE)

(73) Assignee: KNF Neuberger GmbH, Freiburg (DE)

( * ) Notice: Subject to any disclaimer, the term of this patent is extended or adjusted under 35 U.S.C. 154(b) by 0 days.

(21) Appl. No.: 18/847,291

(22) PCT Filed: Mar. 16, 2023

(86) PCT No.: PCT/EP2023/056835
§ 371 (c)(1),
(2) Date: Dec. 16, 2024

(87) PCT Pub. No.: WO2023/175119
PCT Pub. Date: Sep. 21, 2023

(65) Prior Publication Data

US 2025/0198402 A1 Jun. 19, 2025

(30) Foreign Application Priority Data

Mar. 16, 2022 (DE) ..... 10 2022 106 046.2

(51) Int. Cl.
*F04B 39/06* (2006.01)
*F04B 43/02* (2006.01)
*F04B 53/08* (2006.01)

(52) U.S. Cl.
CPC ..... *F04B 39/06* (2013.01); *F04B 39/064* (2013.01); *F04B 43/02* (2013.01); *F04B 53/08* (2013.01)

(58) Field of Classification Search
CPC ..... F04B 39/06; F04B 39/066; F04B 39/064; F04B 43/02; F04B 45/04; F04B 53/08
See application file for complete search history.

(56) References Cited

U.S. PATENT DOCUMENTS 4,006,602 A * 2/1977 Fanberg ..... F25B 31/00 62/505
5,465,581 A * 11/1995 Haertl ..... G01N 30/32 417/313
11,411,552 B2 * 8/2022 Komatsu ..... H03F 3/195

FOREIGN PATENT DOCUMENTS

CN 102536745 A 7/2012
CN 105180305 A 12/2015
CN 205330920 U 6/2016
CN 110374844 A 10/2019
(Continued)

*Primary Examiner* — Charles G Freay
(74) *Attorney, Agent, or Firm* — Smartpat PLC

(57) ABSTRACT

A pump includes a housing which delimits a pressure chamber. The pressure chamber has a pressure chamber feed line and a pressure chamber discharge line. By a displacement device arranged displaceably in the pressure chamber, a fluid flowing into the pressure chamber via the pressure chamber feed line can be exposed to a pressure and can be expelled from the pressure chamber via the pressure chamber discharge line. Furthermore, the pump has a cooling system for cooling the housing of the pump. The cooling system has at least one heat pipe, containing a heat transfer fluid, and at least one heat sink. The at least one heat pipe has a housing contact region for providing heat-conducting contact between the heat pipe and the housing, and, arranged at a distance therefrom, a heat sink contact region for providing heat-conducting contact between the heat pipe and the at least one heat sink.

15 Claims, 13 Drawing Sheets

(56) References Cited

FOREIGN PATENT DOCUMENTS

| | | | |
|---|---|---|---|
| CN | 110454364 | A | 11/2019 |
| DE | 102008061897 | A1 | 6/2010 |
| DE | 102014211843 | A1 | 12/2015 |
| DE | 102015219078 | A1 | 4/2017 |
| EP | 2196671 | A2 | 6/2010 |
| JP | 2002048066 | A | 2/2002 |

* cited by examiner

PUMP COMPRISING A PRESSURE CHAMBER AND A COOLING SYSTEM

CROSS-REFERENCE TO RELATED APPLICATION

This application is a national stage application, filed under 35 U.S.C. § 371, of International Patent Application PCT/EP2023/056835, filed on Mar. 16, 2023, which claims the benefit of German Patent Application DE 10 2022 106 046.2, filed on Mar. 16, 2022.

BACKGROUND

Pumps or compressors are routinely used for conveying fluids. While the fluid to be conveyed is not compressible in pumps, the medium to be conveyed is compressible in compressors. Irrespective of whether a pump or a compressor is used to convey the fluid, in the following, the term "pump" refers to and combines both pumps and compressors in accordance with the definition described at the outset.

Most commercially available pumps comprise a housing that delimits a pressure chamber and comprises an inlet opening and an outlet opening. The inlet opening is connected to a pressure chamber feed line and the outlet opening is connected to a pressure chamber discharge line. Via the pressure chamber feed line, the fluid to be conveyed flows through the inlet opening into the pressure chamber, is exposed to a pressure here by a displacement device arranged displaceably in the pressure chamber, and then flows out through the outlet opening into the pressure chamber discharge line. Many configurations of the displacement device are known from the prior art, wherein, in addition to many other possible configurations, the displacement device can be configured as a piston which is exposed to the pressurised fluid in the form of a piston pump or as a membrane in the form of a membrane pump.

Particularly at high volume flow rates, high pressures or a high conveying speed of the pumps, the conveying of the fluid forces heat to develop in the region of the pressure chamber. The heat that develops in this process has to be dissipated from the pump in order not to damage the pump and to be able to maintain its performance. This is because high conveying speeds have the drawback that frictional heat that heats the medium and the pump itself develops due to the friction of the components that are displaced relative to one another and the fluid to be conveyed. Likewise, heat additionally develops during compression of fluids and in mechanically movable parts of the pump. All of this primarily plays a large part when exposing a gas to a high compression pressure. As already discussed, the heat that has developed has to be dissipated from the pump itself or from the housing in order not to excessively load the mechanical components of the pump or unnecessarily limit the performance of the pump. If the fluid in the pressure chamber is already at a high temperature when flowing in or by being heated by the pump, only a relatively low amount of compression and thus a lower pressure of the fluid can be generated compared with a fluid having a lower temperature, since the thermally induced movement of the fluid particles counteracts compression. If a sufficiently high level of heat dissipation cannot be ensured, only a relatively low amount of compression of the fluid can be achieved by the pump, as a result of which the performance of the pump is limited.

In order to encourage dissipation of the heat, simple configurations of pumps have a housing made of an effectively heat-conducting material, such as a metal or a metal alloy, in order to be able to emit the heat developing owing to the mechanical operation and compression to the housing and ultimately to the surroundings via the housing. Other configurations have an additional cooling system, by means of which individual components or the housing itself can be cooled in order to be able to counteract disadvantageous heating of the housing. A cooling system of this kind can be configured as a water-cooling system, for example, wherein the heat of the housing is transferred to a transfer fluid, such as water, which is in contact with the housing and can reduce the temperature of the housing by absorbing the heat of the housing. Water cooling routinely requires the housing to be cooled to be sufficiently tightly connected to a cooling water circuit and requires suitable control or regulation of the cooling performance brought about by the water cooling. The cooling effect is often not considered sufficient with regard to the required effort.

SUMMARY

The present application presents a pump comprising a cooling system which can be cooled as efficiently as possible in a simple manner. The pump comprises a housing, which delimits a pressure chamber. The pump comprises a pressure chamber feed line and a pressure chamber discharge line, which each lead into the pressure chamber. By means of a displacement device arranged displaceably in the pressure chamber, a fluid flowing into the pressure chamber via the pressure chamber feed line can be exposed to a pressure and can be expelled from the pressure chamber via the pressure chamber discharge line, and comprising a cooling system for cooling the housing of the pump.

The cooling system comprises at least one heat pipe, containing a heat transfer fluid, and at least one heat sink, wherein the at least one heat pipe comprises a housing contact region for providing heat-conducting contact between the heat pipe and the housing, and, arranged at a distance therefrom, a heat sink contact region for providing heat-conducting contact between the heat pipe and the at least one heat sink, wherein, when the cooling system is used as intended, the heat of the housing is transferred via the at least one heat pipe from the housing to the at least one heat sink.

This kind of configuration can achieve effective cooling performance, wherein the heat can be transferred from the heated pump components and/or the housing itself, via the at least one heat pipe, to the heat sink. By cooling the housing, the fluid of the pump that is in contact with the housing and is to be conveyed can also be cooled, meaning that a greater volume flow rate can be conveyed in the same type of pump. For example, by means of a pump configured in this way, temperatures can reliably remain below or comply with temperature limits predetermined by standards, meaning that a greater power density of the pump can be achieved at a consistent temperature.

For this purpose, the configuration comprises at least one heat pipe and at least one heat sink for dissipating the heat from the housing. The at least one heat pipe can be configured as a straight or partially curved pipe here, wherein the heat transfer fluid is located in an interior space surrounded by a pipe wall. The at least one heat pipe is connected to the housing of the pump for heat conduction by the housing contact region of the heat pipe and is connected to the at least one heat sink by the heat sink contact region opposite the housing contact region. Owing to the heating of the housing, the housing contact region of the heat pipe and also the initially liquid heat transfer fluid is heated in the heat pipe to its boiling point, wherein it partially transitions from its liquid phase into the gas phase. Owing to the resulting local pressure changes, the now gaseous medium diffuses within the entire interior space, and condenses out at the colder heat sink contact region by emitting its heat and thus returns to its liquid state, wherein it is heated again and can be fed back into the circuit. The at least one heat pipe can be configured as a pipe having a round, oval, rectangular or otherwise polygonal cross section, and thus can be adapted to the place of use in question and the conditions existing there. Furthermore, the at least one heat pipe can also be a different shape or an alternating shape in portions.

In this case, the at least one heat pipe is preferably configured as a passively acting heat pipe, by the interior space in the at least one heat pipe being divided into a plurality of capillaries. As a result, the heat transfer fluid condensed on the heat sink contact region can be conducted back to the housing contact region by capillary action. It is not necessary to separately actively return the condensed heat transfer fluid to the housing contact region, meaning that the construction and operation of the cooling system is considerably simplified. The use of a heat pipe configured as a heat pipe allows both for high heat flux densities in any orientation and also for use which is independent of returning the condensed heat transfer fluid by gravity. Other configurations of the heat pipe and, where necessary, actively controlled operation of the heat pipe are also possible, however.

The at least one heat sink itself can be configured as a passively cooled or an actively cooled component, which emits the heat transferred via the at least one heat pipe from the housing to the at least one heat sink to the ambient air. The at least one heat sink has the highest possible thermal conductivity in order to make it possible to rapidly transport the heat away from the pump housing. The at least one heat sink can itself be arranged on the housing by a heat sink contact surface or can be in contact with a housing wall, or can also be integrally formed therewith, in order to also allow for heat transfer directly from the housing to the at least one heat sink in addition to the heat transfer via the at least one heat pipe from the housing to the at least one heat sink. In this way, the heat transfer and therefore also the cooling performance can be increased. In an alternative configuration, the heat sink can also be arranged to be spatially separate from the housing, wherein the heat transfer to said housing inclusive takes place via the at least one heat pipe.

In addition to a configuration of the pump having a single heat pipe and a single heat sink, configuration variants are also provided in which a plurality of heat pipes connect the housing to a jointly used heat sink, or a heat pipe connects the housing to a plurality of heat sinks, or a plurality of heat pipes connect the housing to a plurality of heat sinks. Therefore, the cooling of the pump and the cooling performance required thereby can be adapted to the requirements of the pump.

It is also optionally provided that the at least one heat sink comprises a heat sink block and a cooling fin assembly that is connected to the heat sink block for heat conduction and comprises a plurality of cooling fins arranged at a distance from one another, wherein the heat absorbed by the heat sink block is emitted to the ambient air via the cooling fins. The heat sink block and/or the cooling fins can be made of a particularly effectively heat-conducting material, such as a metal or a metal alloy, and can in particular be made of aluminium and/or copper. Alternatively, the heat sink block and/or the cooling fins can also be made of or coated with another effectively heat-conducting material or composite material. In this case, the heat sink block is preferably configured such that the heat transferred to the heat sink block via the at least one heat pipe or transferred directly to the heat sink block via the housing can be rapidly absorbed, such that heat can flow from the housing towards the heat sink block again. To do this, the heat sink contact region of the at least one heat pipe can be directly connected to the heat sink block via a direct contact, or a particularly heat-conductive heat-conducting paste can also be arranged between the two components, in order to make the heat transfer as efficient as possible and to additionally increase it.

For improved heat emission from the heat sink to the ambient air, the cooling fin assembly can be arranged on the heat sink block. The cooling fin assembly preferably comprises a plurality of cooling fins arranged at a distance from one another, which can be implemented as plates arranged at a distance from one another, for example. These cooling fins or plates particularly preferably have the largest possible surface area while simultaneously having the smallest possible volume, in order to be able to rapidly emit the heat transferred from the heat sink block to the cooling fins to the ambient air owing to the large contact surface between the cooling fins and the ambient air. In this case, the cooling fins can also comprise partially or fully penetrating cut-outs or shaped portions that are different from a plate.

The heat transfer from the heat sink block to the cooling fins can be improved by configuring the heat sink block to be integral with the cooling fins, in order to configure the heat transfer to be particularly effective. Alternatively, however, the cooling fins can also be connected to the heat sink block for heat conduction by another type of suitable connection. In a non-integral configuration, a suitable heat-conducting paste having a high thermal conductivity can also be arranged between the heat sink block and the cooling fins in order to improve the heat-conducting connection of the cooling fins to the heat sink block. In an alternative configuration option, the at least one heat pipe can also be arranged directly on the cooling fins by its heat sink contact region in order to be able to emit the heat directly to the cooling fins, while bypassing the heat sink block. In a configuration of this kind, it may be advantageous for the at least one heat pipe to be arranged on the cooling fins in a longitudinal direction in order to allow for the largest possible contact surface between the at least one heat pipe and the cooling fins.

This configuration of the cooling system is based on purely passive elements. Therefore, the pump can be cooled cost-effectively, very efficiently, and also quietly, since moving parts of the cooling system can be omitted.

Furthermore, an airflow generating device is arranged on the at least one heat sink, wherein an air flow can be generated by the airflow generating device for additional cooling of the cooling fins. In addition to the purely passive cooling of the cooling fins of the at least one heat sink, as already discussed, wherein the heat absorbed by the cooling fins is emitted to the ambient air and transported away by convection, it can also be provided to actively cool the cooling fins. To do this, the air flow generated by the airflow generating device can be conducted over the cooling fins, as a result of which they can be additionally cooled, and the air flow also encourages the warm ambient air to be transported away in addition to the purely convective flows. For this purpose, the airflow generating device can be configured as a fan arranged on the cooling fins, which fan blows the generated air flow directly onto or through the cooling fins arranged at a distance from one another. This allows for a compact arrangement of the cooling system in the smallest possible space, since a lower number of cooling fins can be used owing to the additional active cooling. In an alternative configuration, the airflow generating device can also be arranged at a distance from the heat sink, wherein the air flow can be blown onto the cooling fins via one or more suitable air ducts.

In an advantageous configuration, it is provided that the cooling system comprises a water-cooling device for cooling the heat sink contact region of the at least one heat pipe. In addition to the additional cooling of the cooling fins by the airflow generating device, the cooling system can alternatively also comprise a water-cooling device. In this case, the heat of the heat sink contact region of the at least one heat pipe can be transferred by water that is in contact with or flows past the heat sink contact region or by another fluid having high thermal conductivity. The fluid heated in this way can be conducted in a circuit, wherein it is subjected to alternating heating and cooling.

The water-cooling device can enclose the at least one heat pipe at the heat sink contact region in portions or completely, for example in the form of a pipe that surrounds the heat pipe in portions or is guided around the heat pipe in a coiled manner. The water flowing in the pipe can absorb the heat of the at least one heat pipe along the contact region and can dissipate it from the at least one heat pipe. In this case, the pipe is preferably constructed as a closed system, in which the heated water is located in a circuit system. The heated water is transported away, cools in the process, potentially with the use of further passive or active cooling, and can then be used again for cooling the heat sink contact region of the at least one heat pipe.

Furthermore, it is optionally provided that the at least one heat pipe is arranged in heat sink cut-outs in the heat sink block by the heat sink contact region and is connected to the heat sink block for heat conduction. By arranging the at least one heat pipe or its heat sink contact region in heat sink cut-outs in the heat sink block, the most effective possible heat transfer can be obtained by the contact surface between the at least one heat pipe and the heat sink block being as large as possible. The larger this contact region, the more heat can be transferred between the two components per unit time. In this case, the at least one heat pipe can preferably also have one or more curvatures in order for it to be possible to further enlarge this contact region. Alternatively or additionally, a plurality of heat pipes, which are arranged in a plurality of heat sink cut-outs in the heat sink block, can also be used for effective heat transfer. Furthermore, it is also possible for the at least one heat pipe to be arranged in cooling fin cut-outs in the cooling fins, wherein the absorbed heat can be directly transferred to one or more cooling fins.

The heat sink cut-out and/or the cooling fin cut-out can be adapted to the shape of the at least one heat pipe in order to configure the contact surface between the at least one heat pipe and the heat sink block or between the at least one heat pipe and the cooling fins to be as large as possible. Alternatively, the heat sink cut-out and/or the cooling fin cut-out can have a shape that deviates from the at least one heat pipe, wherein, in both cases, the heat sink cut-out and/or the cooling fin cut-out can be lined with a particularly effectively heat-conducting paste for optional heat transfer. A heat-conducting paste of this kind allows manufacturing tolerances such as smaller uneven areas in surfaces and thus a smaller contact region to be evened out if the at least one heat pipe and the heat sink block are not integrally formed.

According to one configuration, it is provided that the heat sink contact region of the at least one heat pipe is connected to a contact plate for heat conduction, wherein the contact plate has a high thermal conductivity of greater than 200 W/m·K and in particular of greater than 300 W/m·K, and wherein the contact plate can be cooled by the airflow generating device or is connected to the at least one heat sink. In order to configure the contact region and thus the heat transfer to be as effective as possible, the heat sink contact region of the at least one heat pipe can be connected to the contact plate, or can be extended thereto. The contact plate is preferably made of a particularly effectively heat-conducting material such as aluminium, and particularly preferably of a material such as copper and/or silver and/or gold and/or alloys thereof, in order to facilitate optimal heat transfer from the at least one heat pipe to the contact plate and ultimately optimal heat transfer away from the contact plate. For a particularly effective connection, the at least one heat pipe can likewise be made of the same material as the contact plate.

For this purpose, the contact plate can preferably be configured as a planar plate which has a larger surface area towards the heat sink or the airflow generating device than the heat sink contact region of the at least one heat pipe in order to configure the further heat transfer to be as effective as possible. Here too, the connection of the components to one another can be increased by the use and suitable arrangement of a heat-conducting paste. On the basis of the configuration of the heat sink block, wherein the at least one heat pipe has at least one curvature in its heat sink contact region, the heat sink contact region of the at least one heat pipe can likewise have at least one curvature in the configuration with a contact plate in order to increase the contact region between the two components and thus the heat transfer.

It is optionally provided that the cooling fins are arranged in parallel with a surface of the housing. The cooling fins of the cooling fin assembly can be arranged on the heat sink block at a distance from one another and can be arranged in parallel with the surface in this case. In addition to arranging the individual cooling fins on the cooling fin block, the individual cooling fins can be arranged at a distance from one another and in parallel with one another, wherein they are only interconnected by the at least one heat pipe, thus resulting in an arrangement that is layered in one direction and is supported by the at least one heat pipe.

According to one configuration, it is provided that the cooling fins are arranged at an angle to the surface of the housing. Cooling fins of this kind that are arranged to be tilted at an angle to the surface can be particularly effectively adapted to the available installation space or to spatial requirements at the intended place of operation of the pump.

It is optionally provided that the pressure chamber feed line and/or the pressure chamber discharge line extend in parallel with the heat sink block and/or are embedded therein over a large area as far as possible. Owing to the consistent and shortest possible distance between the lines and the heat sink, an arrangement of the pressure chamber feed line and/or the pressure chamber discharge line extending in parallel with the heat sink block allows for a large contact region, in which there can be an optimal heat exchange between both components and thus cooling of the pump itself. This allows for cooling of the pressure chamber feed line and in particular the pressure chamber discharge line, wherein the pressure chamber discharge line routinely has a higher temperature than the pressure chamber feed line owing to the heat that develops during the compression of the fluid. Therefore, for effective cooling, it may be advantageous for the pressure chamber discharge line in particular to be a shorter distance from the heat sink block, which extends in parallel therewith over the longest possible distance.

In this case, the two lines can be embedded in the housing of the pump, can be arranged in a cut-out on a side of the housing facing the heat sink block, or can be directly arranged in the heat sink block. A shorter distance between the lines and the heat sink block can facilitate more effective heat transfer and thus more effective cooling. This heat transfer can be configured to be more effective the greater the temperature difference between the lines and the housing or the heat sink block.

According to one configuration, it can be provided that the pressure chamber feed line and/or the pressure chamber discharge line extend in parallel with the pressure chamber. Owing to an arrangement of this kind, effective heat transfer can be facilitated by the proximity of the components and the associated large contact region. For effective heat transfer, it may therefore be advantageous for the pressure chamber feed line and/or the pressure chamber discharge line to be arranged both in parallel with the pressure chamber and in parallel with the heat sink block.

It is optionally provided that a course of the at least one heat pipe has at least one change in direction, such that the at least one heat pipe has the longest possible contact region between the at least one heat pipe and the heat sink block and/or between the at least one heat pipe and the housing. The larger the contact surface between the at least one heat pipe and either the heat sink block or the housing, the more effectively the heat of the housing can be transferred to the at least one heat pipe and ultimately to the heat sink block. One configuration of the at least one heat pipe to have at least one change in direction and preferably a plurality of changes in direction allows for such an enlargement of the contact surface by the housing contact region and/or the heat sink contact region having a contact surface with the heat sink and/or the housing that is maximised as far as possible. To do this, the at least one heat pipe can have, on both portions, a meandering course having regions that are optionally oriented in parallel with one another. Furthermore, spiral-like, zigzag-shaped, meandering and other kinds of configurations of the course of the at least one heat pipe which have the largest possible surface area and thus the largest possible contact region are also conceivable.

It is preferably provided that the cooling system comprises at least two heat pipes, wherein the at least two heat pipes are arranged on the at least one heat sink by their respective heat sink contact regions from two opposite sides. The use of two or more heat pipes encourages the cooling thereof owing to the heat being separately transported away from the housing, by a quantity of heat being able to flow away from the housing via each heat pipe without the heat pipes being subject to an excessive load. Because a plurality of heat pipes are arranged on or in the cooling block from different sides, the heat can be evenly distributed over the cooling block, wherein it only has a few regions having different temperatures and thus evenly absorbs and also emits heat. This allows for the most effective and rapid possible cooling.

It is also possible and optionally provided that the housing contact region of the at least one heat pipe is arranged in parallel with the pressure chamber feed line and/or the pressure chamber discharge line. A parallel arrangement of this kind having the shortest possible distance between the lines and the at least one heat pipe can make a significant contribution to more effectively transporting heat away. The heat emitted to the surrounding housing by the pressure chamber discharge line in particular can then be emitted to the at least one heat pipe over the shortest possible distance. The shorter the distance and the greater the overall parallel course, the more heat can be transferred in the process. Here, the at least one heat pipe can be arranged with its housing contact region fully or partially in parallel with the lines, although the at least one heat pipe can also be arranged in a spiral shape around both or one of the lines, for example.

It is preferably provided that the housing contact region of the at least one heat pipe is arranged between the pressure chamber feed line and/or the pressure chamber discharge line and the pressure chamber. During operation of a pump, most of the heat develops in or on the pressure chamber, wherein said pressure chamber together with the pressure chamber discharge line routinely has the greatest quantity of heat and thus the greatest load. Therefore, it may be considered particularly advantageous for the housing contact region of the at least one heat pipe to be in the closest possible contact with a large contact surface in these regions. In one configuration of the cooling system, the housing contact region of the at least one heat pipe can be arranged between the pressure chamber and the pressure chamber feed line and/or pressure chamber discharge line, wherein the heat sink contact region of the at least one heat pipe is arranged in the heat sink cut-outs in the heat sink.

In an advantageous embodiment, it is provided that the pump is a membrane pump. The cooling system can advantageously be used in a membrane pump and provides the above-mentioned advantages in doing so.

Other advantageous configurations of the pump comprising a cooling system are explained with reference to exemplary embodiments shown in the drawings, in which:

DETAILED DESCRIPTION

Figure 1:
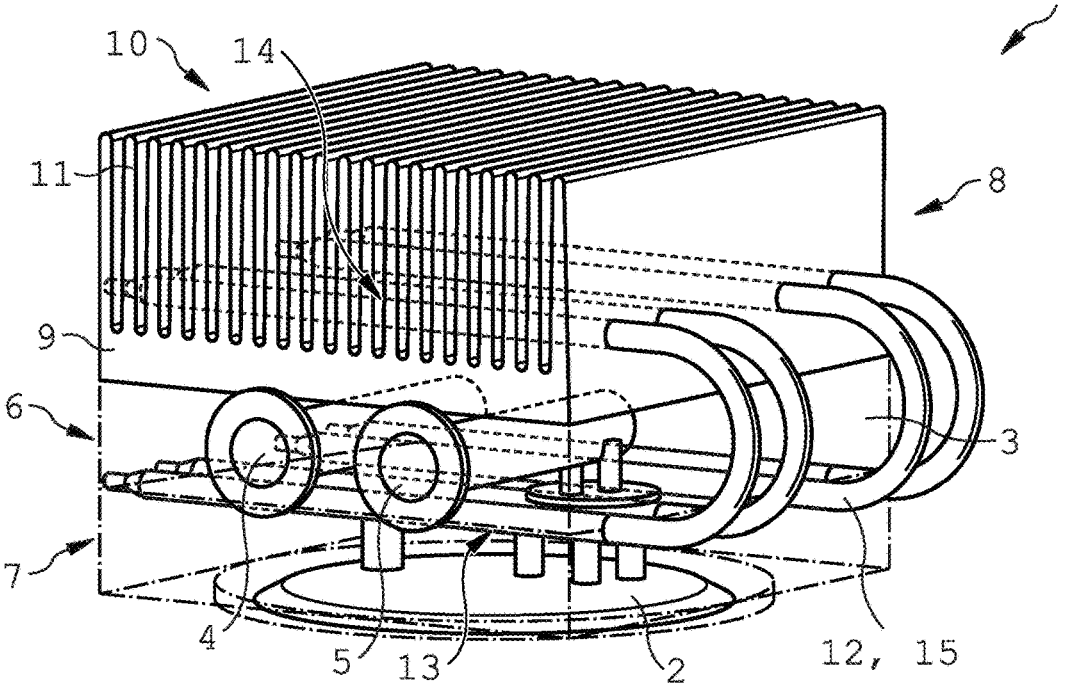
FIG. 1 shows a claimed configuration of a pump comprising a cooling system for cooling a housing of the pump and comprising horizontally arranged heat pipes.

FIG. 1 shows a configuration of a segment of a pump 1 comprising a cooling system. In this figure, for the sake of clarity some components which are made of a non-transparent material, such as metal, are shown to be transparent. The pump 1 serves to convey a fluid through the pump 1, wherein just one small region of a pressure chamber 2, through which the fluid is conveyed, is shown. The cooling system dissipates the heat generated by the operation of the pump 1 from the pump 1 and thus cools the pump 1 and the fluid conveyed thereby. Owing to the claimed cooling of the pump 1 and thus also indirectly owing to the fluid conveyed thereby, in a comparable type of pump 1, a greater volume flow rate of the fluid can be conveyed at an unchanged operating temperature of the pump 1.

The pump 1 comprises a housing 3 that delimits the pressure chamber 2 and comprises a pressure chamber feed line 4 and a pressure chamber discharge line 5. FIG. 1 and the following figures only show part of the pressure chamber 2 here. Via the pressure chamber feed line 4, which is connected to an inlet opening of the pressure chamber 2, the fluid to be conveyed is introduced into the pressure chamber 2 through an inlet opening, is exposed to a pressure here by a displacement device (not shown), and then flows out through an outlet opening into the pressure chamber discharge line 5. In this case, the housing 3 can be notionally divided into two adjacent regions having a different course of the pressure chamber feed line 4 and the pressure chamber discharge line 5. In a pressure chamber lead-in region 6, the pressure chamber feed line 4 and the pressure chamber discharge line 5 have a course that passes by the pressure chamber 2 in order to be lead to the pressure chamber 2 in the most space-saving manner possible and in order to allow for free installation space as close as possible to the pressure chamber 2 for other components of the cooling system. In a pressure chamber opening region 7, the pressure chamber feed line 4 and the pressure chamber discharge line 5 extend substantially perpendicularly to an adjacent surface of the pressure chamber 2 and open into the pressure chamber 2 at a distance from one another. Owing to the substantially perpendicular course within the pressure chamber opening region 7, undesired heat absorption by the pressure chamber feed line 4 and the pressure chamber discharge line 5 from the pressure chamber 2 heated during operation can be reduced.

A heat sink 8 is also arranged on the housing 3 so as to be adjacent to the pressure chamber lead-in region 6. The heat sink 8 comprises a heat sink block 9 in the form of a block that is connected to the housing 3 for heat transfer and has high thermal conductivity. A cooling fin assembly 10 that is formed integrally with the heat sink block 9 and comprises a plurality of cooling fins 11 configured as plates is arranged on a side of the heat sink block 9 facing away from the housing 3. Here, the cooling fins 11 are arranged in parallel with one another and at a right angle to the housing 3. During operation of the pump 1, most of the heat often develops within the pressure chamber 2 as well as due to the compression of the fluid to be conveyed and the associated heating likewise in the pressure chamber discharge line 5. This heat is transferred via the housing 3 to the heat sink block 9 arranged on the housing 3 and ultimately to the individual cooling fins 11. Owing to the configuration of the cooling fins 11 as plates having the largest possible surface area together with the smallest possible volume, effective transfer of the heat of the cooling fins 11 to the ambient air surrounding the cooling fins can be achieved.

For more effective heat transfer between the housing 3 and the cooling fins 11, the cooling system comprises a plurality of heat pipes 12 comprising a housing contact region 13 and a heat sink contact region 14 arranged at a distance therefrom. In this case, the heat pipes 12 are constructed as heat pipes 15. These heat pipes 15 are configured as pipes having a circular cross-sectional area, although other cross-sectional areas such as oval or flat shapes are also conceivable. A plurality of capillaries and a heat transfer fluid having high thermal conductivity are arranged in the interior space in the closed pipes. In the housing contact region 13, the liquid heat transfer fluid flowing therein is heated and partially transitions into the gas phase in the process. The gaseous heat transfer fluid diffuses within the entire interior space in the heat pipe 12 and condenses out in the heat sink contact region 14 by emitting its heat to the heat sink 8, and thus returns to its liquid state. The liquid heat transfer fluid is conducted through the capillaries from the heat sink contact region 14 back to the housing contact region 13.

The individual heat pipes 15 are arranged by the housing contact region 13 in cut-outs in the housing 3 in a region between the pressure chamber 2 and the pressure chamber feed line 4 or pressure chamber discharge line 5 and, in the process, extend in parallel with and at a right angle to the lines 4, 5. By arranging the housing contact region 13 in the proximity of the pressure chamber feed line 4 and pressure chamber discharge line 5 and on the pressure chamber 2, the heat is absorbed and effectively dissipated by the heat pipes 15 immediately at the point at which it develops. The heat sink contact region 14 of the heat pipes 15 is arranged in heat sink cut-outs in the heat sink 8 and extends in parallel with a contact surface of the heat sink 8 with the housing 3 and in parallel with the housing contact region 13 of the heat pipes 15. All four heat pipes 15 shown in FIG. 1 also extend in parallel with and at a distance from one another and are configured to be identical to one another.

In the following figures, comparable configurations of the pump 1 comprising the cooling system are shown in configurations that differ from one another. Only significant differences in the individual variants which are shown in the figures are discussed in the following.

Figure 2:
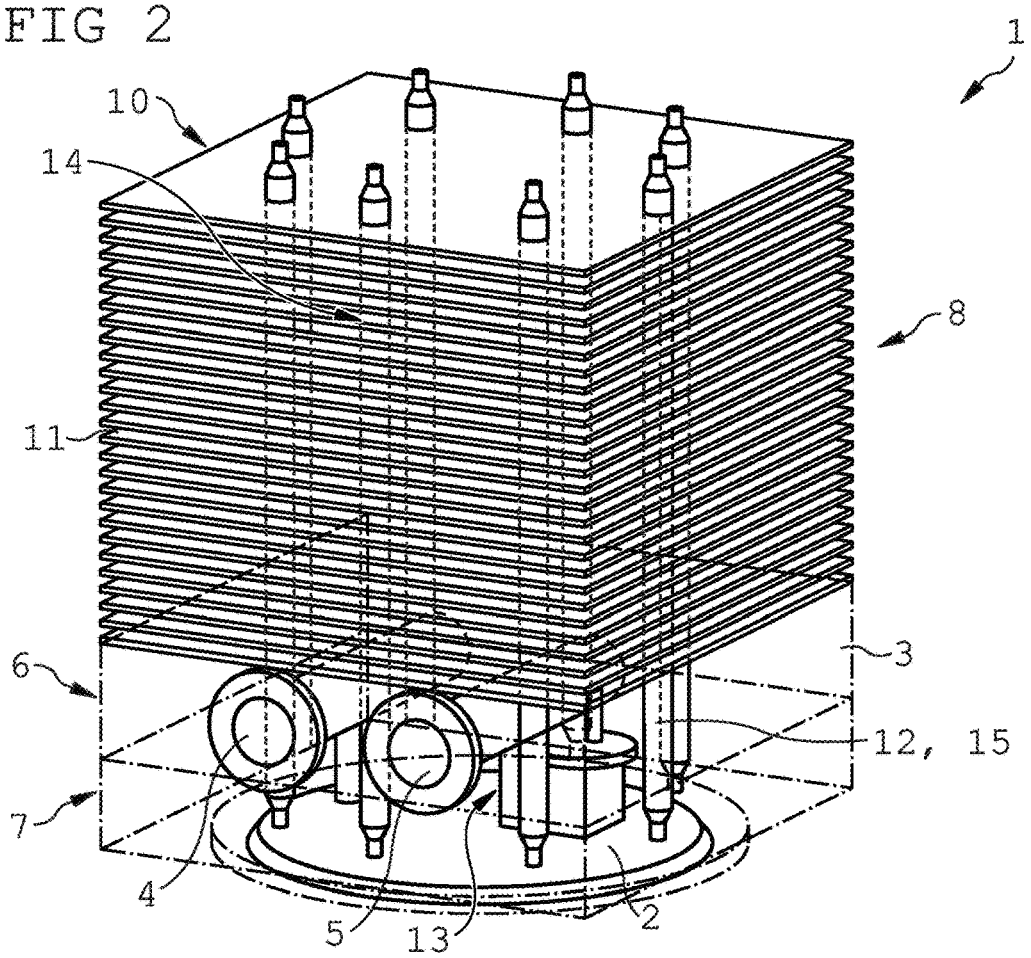
FIG. 2 shows a configuration of the pump having a vertical arrangement of the heat pipes.
Figure 3:
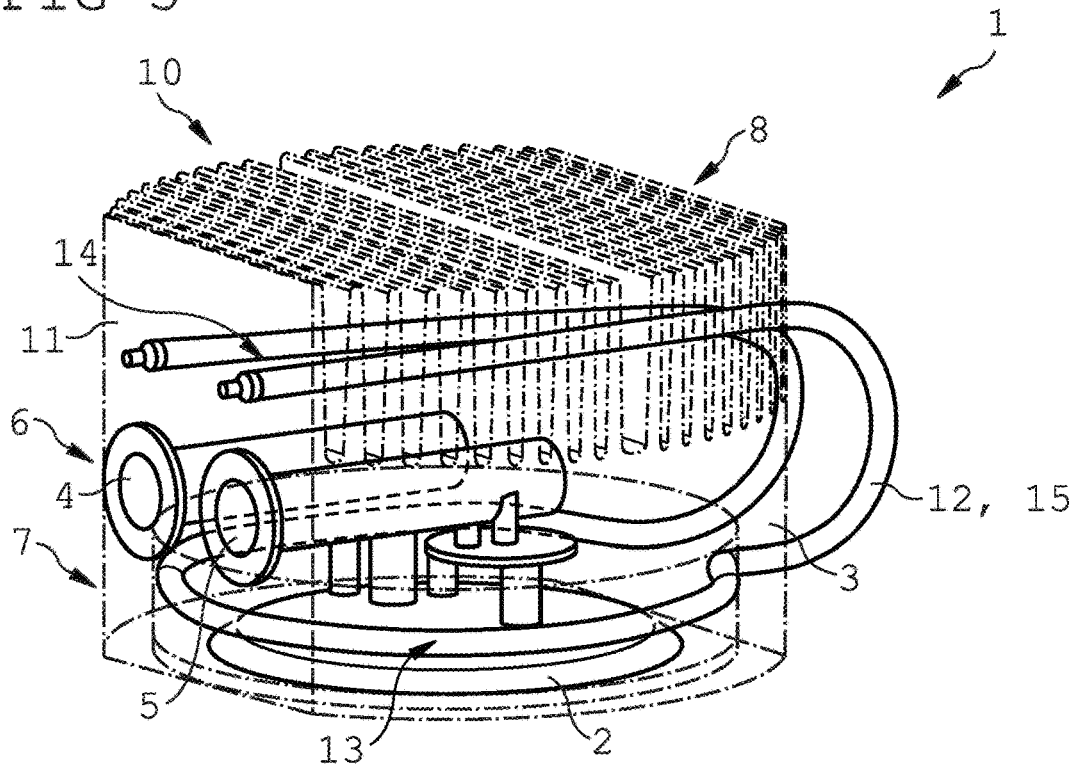
FIG. 3 shows a configuration of the pump comprising a radially formed heat pipe.
Figure 4:
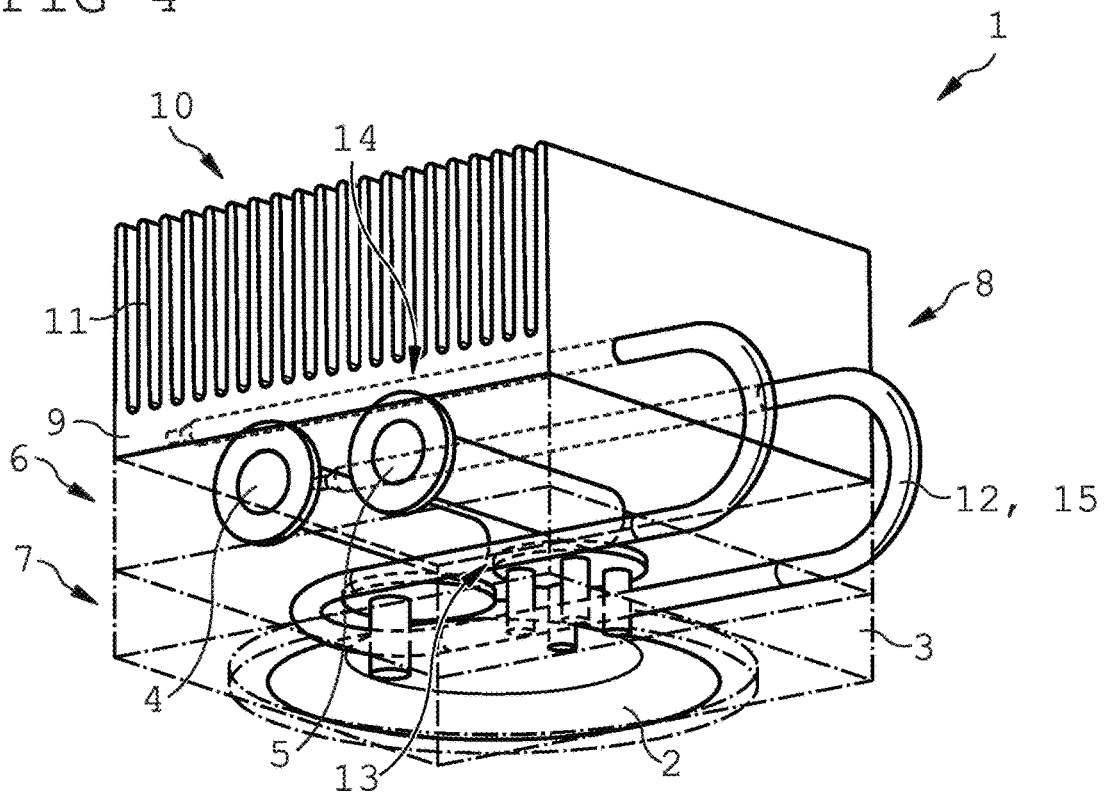
FIG. 4 shows a configuration of the pump comprising a curved housing contact region of the heat pipe.
Figure 5:
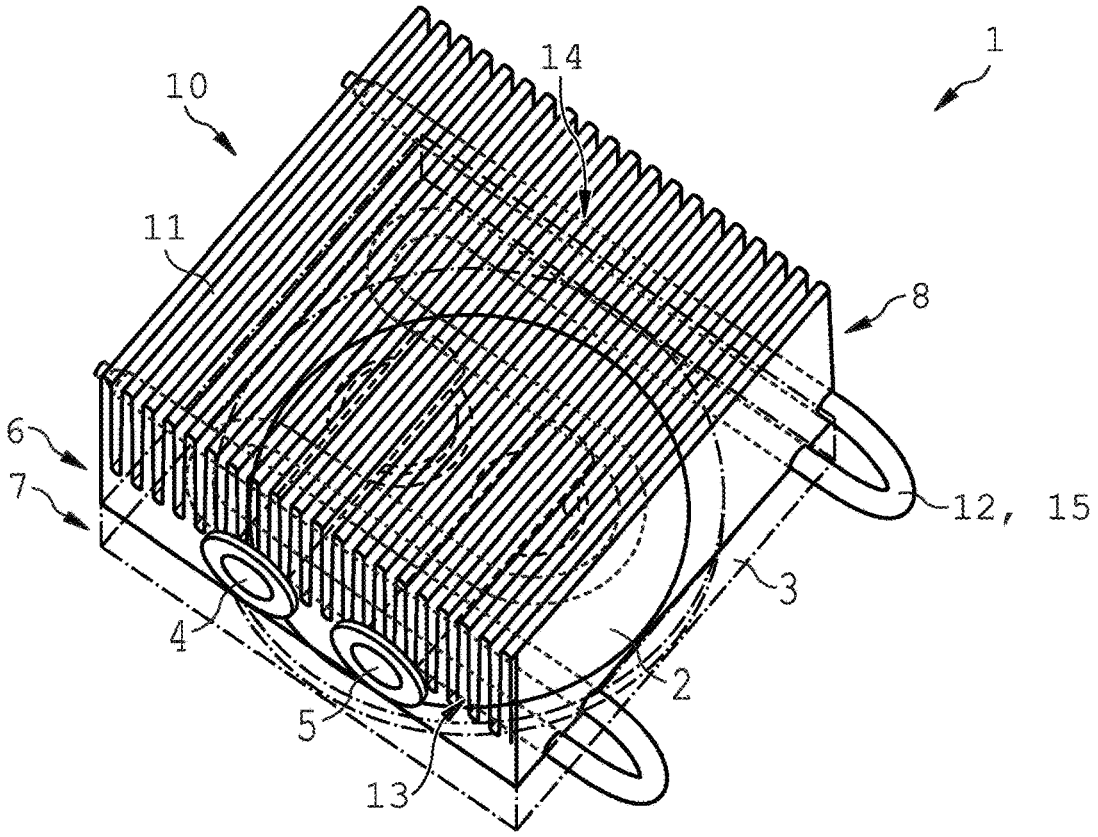
FIG. 5 shows a configuration of a meander-like housing contact region of the heat pipe.

FIGS. 2 and 3 each show a different configuration of the claimed arrangement of the heat pipes 15. In FIG. 2, the heat pipes 15 are arranged in the form of straight pipes at a right angle to a surface of the housing 3, wherein they are arranged in the housing 3 by the housing contact region 13. The heat sink 8 also does not comprise a heat sink block 9, but instead the individual cooling fins 11 are produced as plates which are arranged in a stack-like manner so as to be at a distance from one another, and are each arranged in parallel with the housing 3 and are only connected to one another and to the housing 3 by the individual heat pipes 15.

FIG. 3, however, shows a radially extending variant of the heat pipe 15, wherein the heat pipe 15 is arranged in the pressure chamber opening region 7 so as to radially extend within the housing contact region 13. In this way, the heat that develops can be particularly effectively dissipated to the pressure chamber 2 and the outlet opening. Furthermore, the cooling fins 11 are formed integrally on the housing 3.

In addition to the straight-line configuration of the housing contact region 13 from FIG. 1 or 2, FIGS. 4 and 5 each show alternative configurations of this housing contact region 13 or the course of the heat pipe 15 in this housing contact region 13 in the form of a curve or with a meandering shape.

Figure 6:
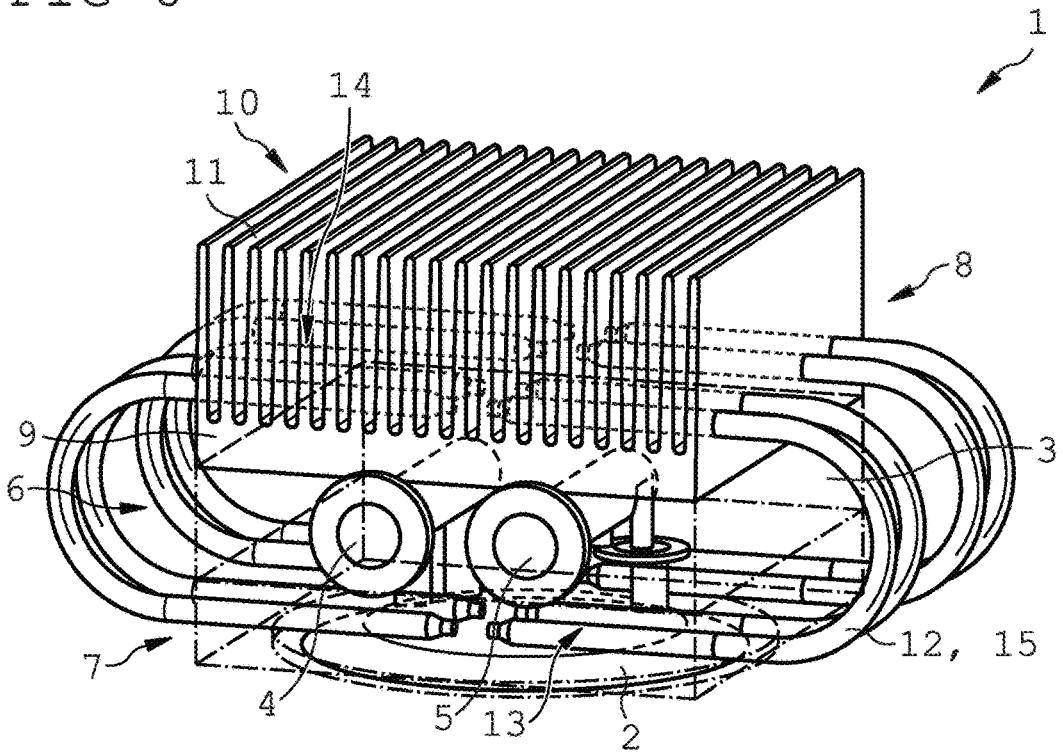
FIG. 6 shows a configuration of the pump, wherein a plurality of heat pipes are arranged on the heat sink from opposite sides.

FIG. 6 shows an alternative configuration of the heat pipe 15 from FIG. 1, wherein a plurality of heat pipes 15 contact and penetrate the cooling fins 8 from opposite sides.

Figure 7:
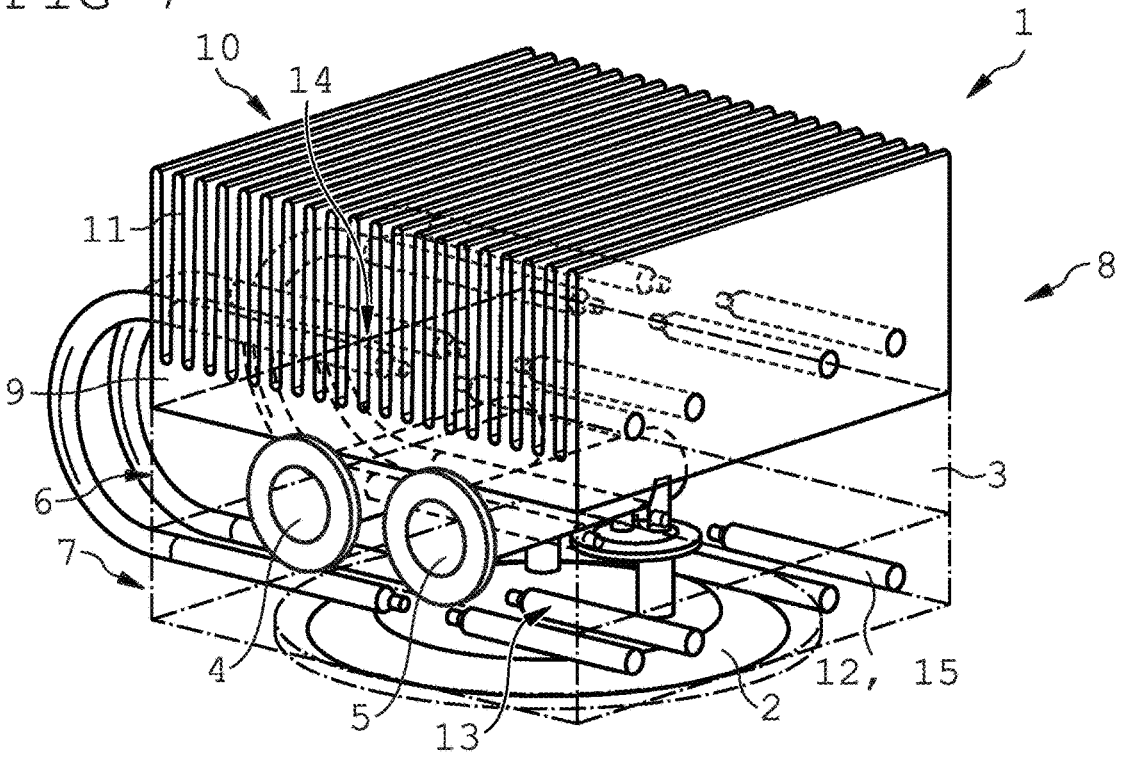
FIG. 7 shows a configuration variant of the housing contact region of the heat pipe in a round cut-out.
Figure 8:
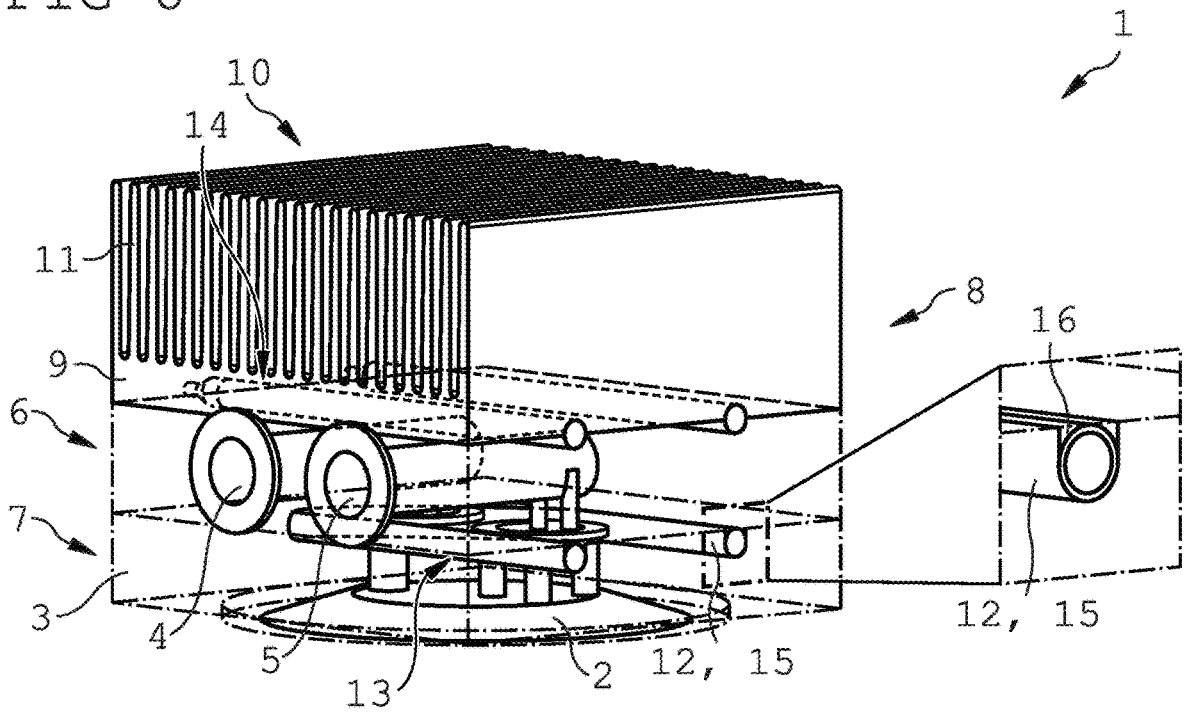
FIG. 8 shows a configuration variant of the housing contact region of the heat pipe in a semi-circular cut-out.
Figure 9:
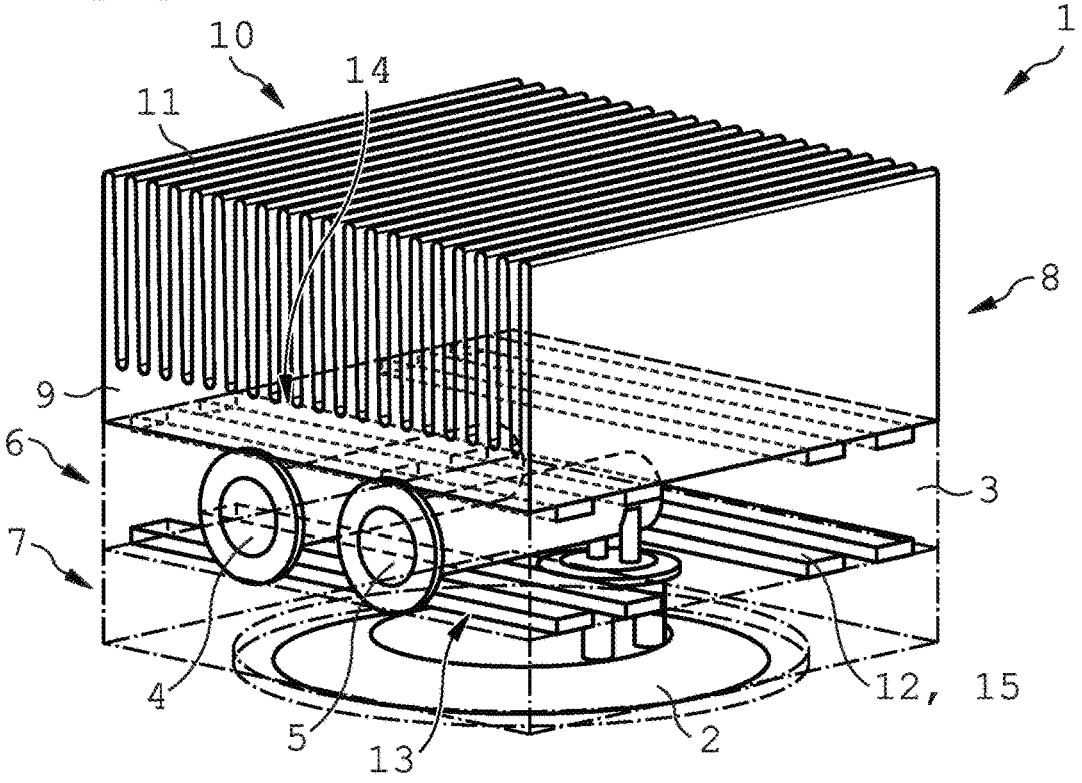
FIG. 9 shows a configuration variant of the housing contact region of the heat pipe in a rectangular cut-out.
Figure 10:
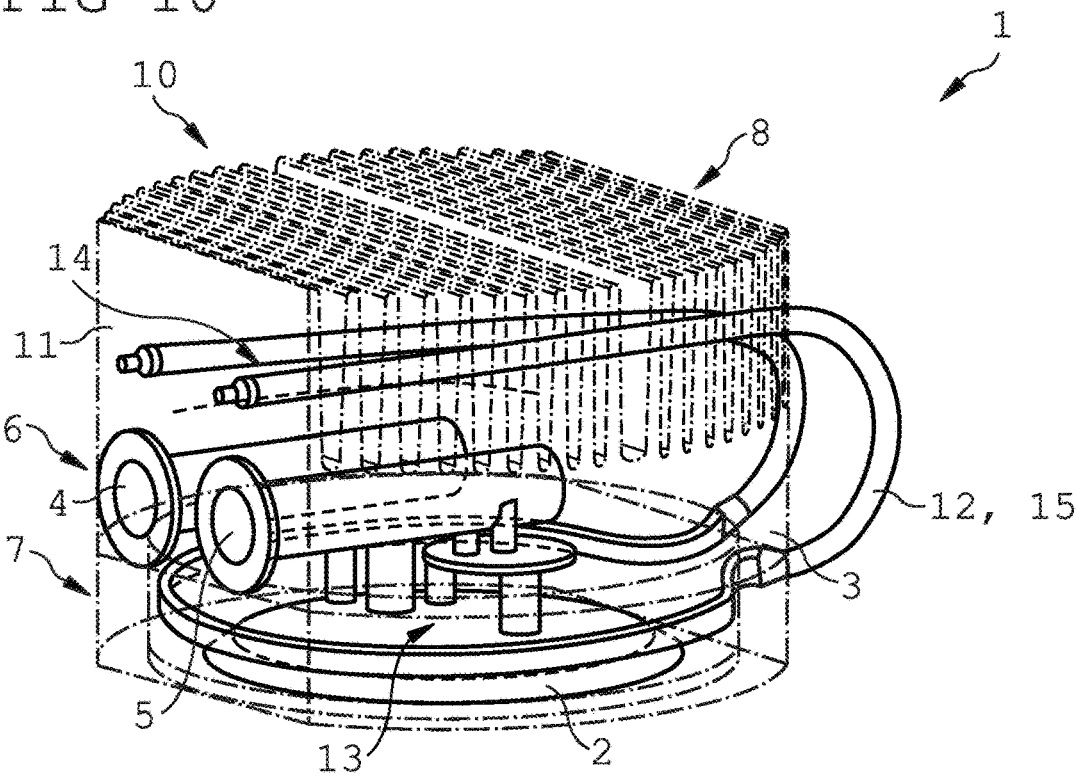
FIG. 10 shows an alternative configuration variant of the housing contact region of the heat pipe in the rectangular cut-out.

The following figures, FIGS. 7 to 10, each show different configuration options for the arrangement of the heat pipes 15 in differently configured cut-outs in the housing 3. While the cut-out in FIG. 7 and FIGS. 9 and 10 is adapted to the configuration of the heat pipes 15 having a round cross section or to a rectangular cross section and the heat pipes 15 are each positioned to be flush in the cut-outs 16, FIG. 8 shows another configuration option, wherein the pressure chamber opening region 7 and the adjacent pressure chamber lead-in region 6 of the housing 3 are produced separately from one another and the heat pipe 15 configured to have a round cross section is arranged within the pressure chamber opening region 7 in a semi-circular cut-out 16.

Figure 11:
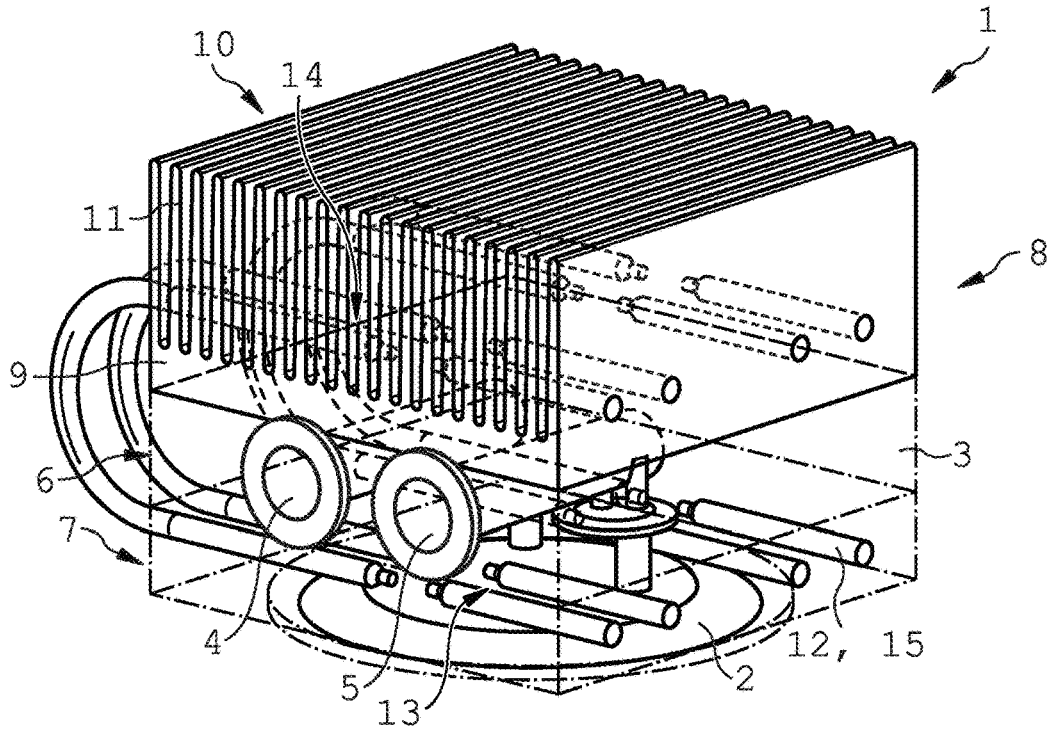
FIG. 11 shows an arrangement of the housing contact region in a pressure chamber housing region.
Figure 12:
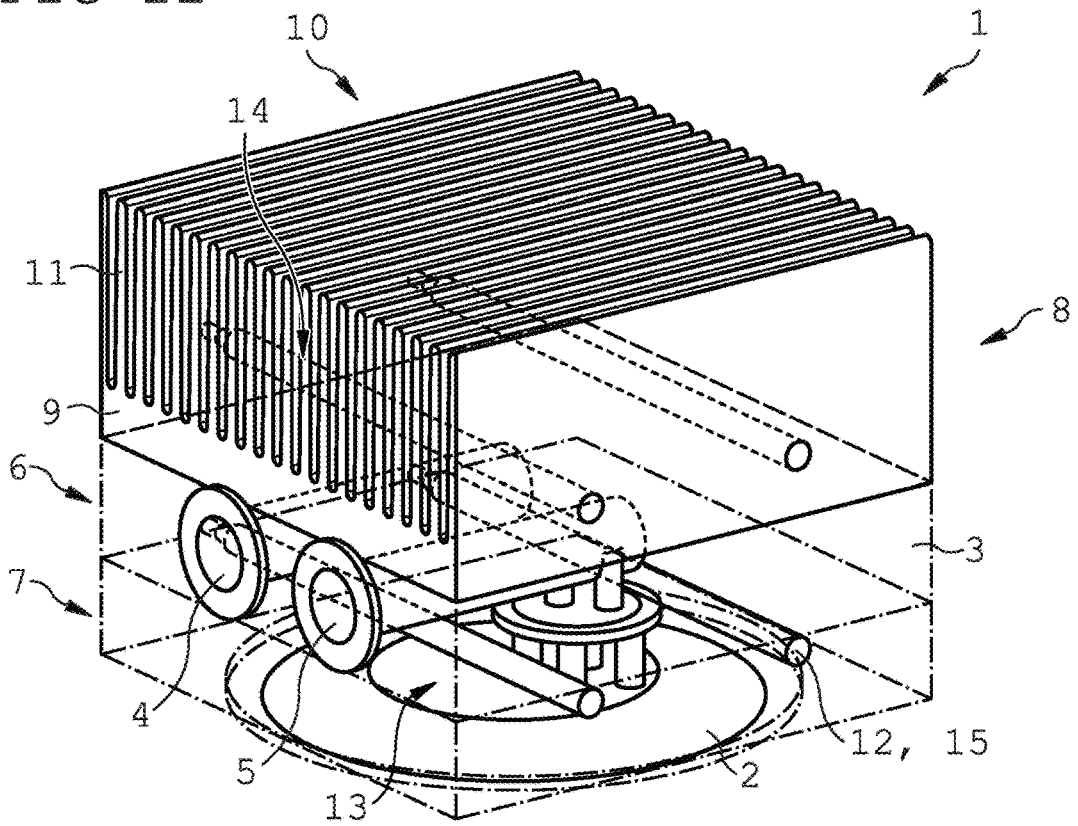
FIG. 12 shows an arrangement of the housing contact region in the pressure chamber housing region on a contact surface with a pressure chamber line region.
Figure 13:
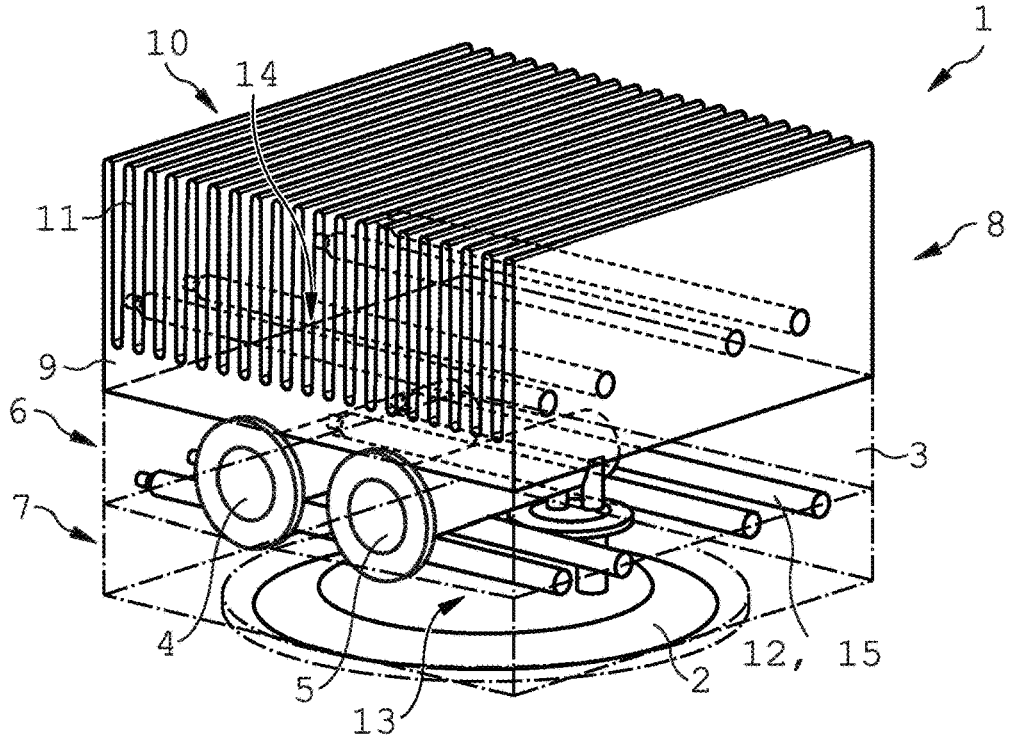
FIG. 13 shows an arrangement of the housing contact region between the pressure chamber housing region and the pressure chamber line region.
Figure 14:
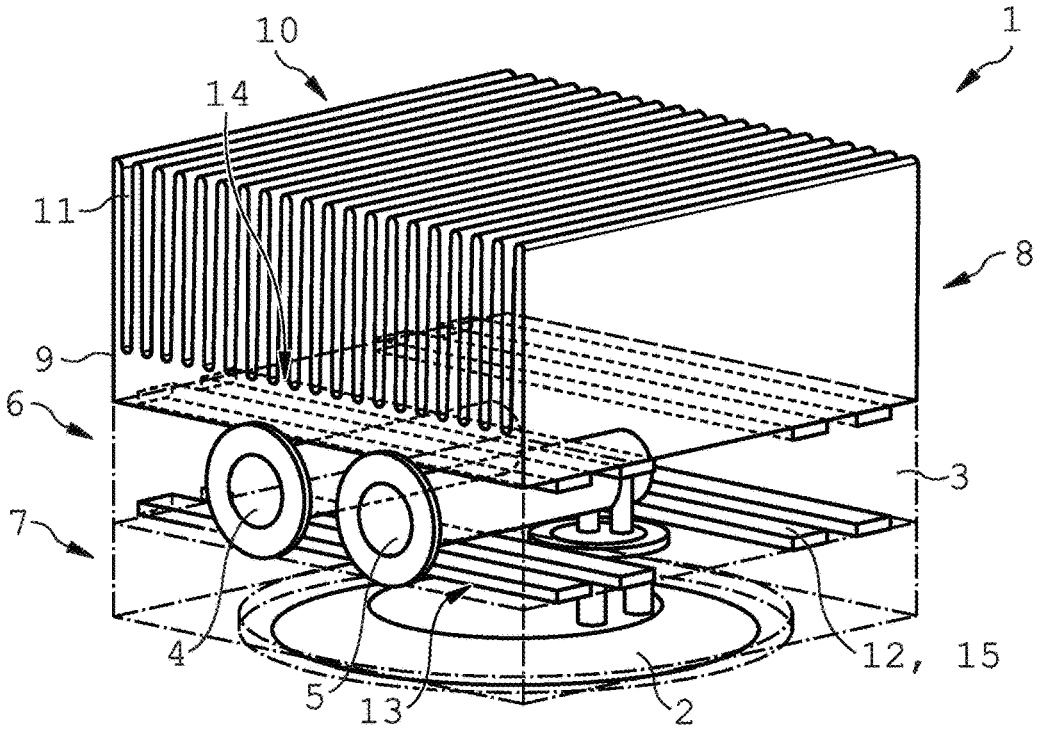
FIG. 14 shows an arrangement of the housing contact region in the pressure chamber line region on a contact surface with a pressure chamber housing region.
Figure 15:
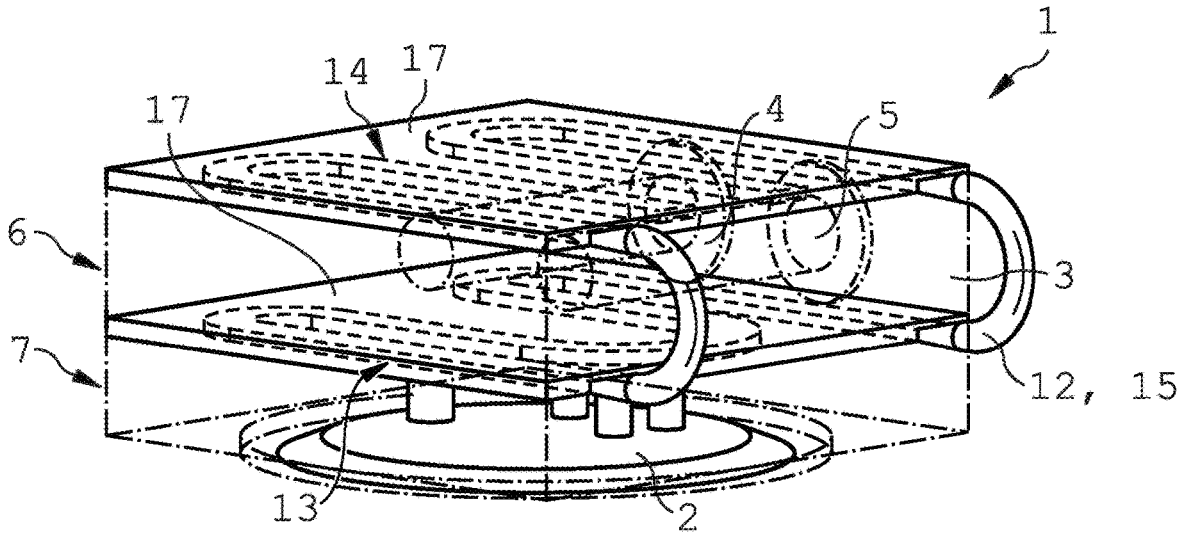
FIG. 15 shows a configuration of the housing contact region and a heat sink contact region of the heat pipe each comprising a contact plate arranged thereon.
Figure 16:
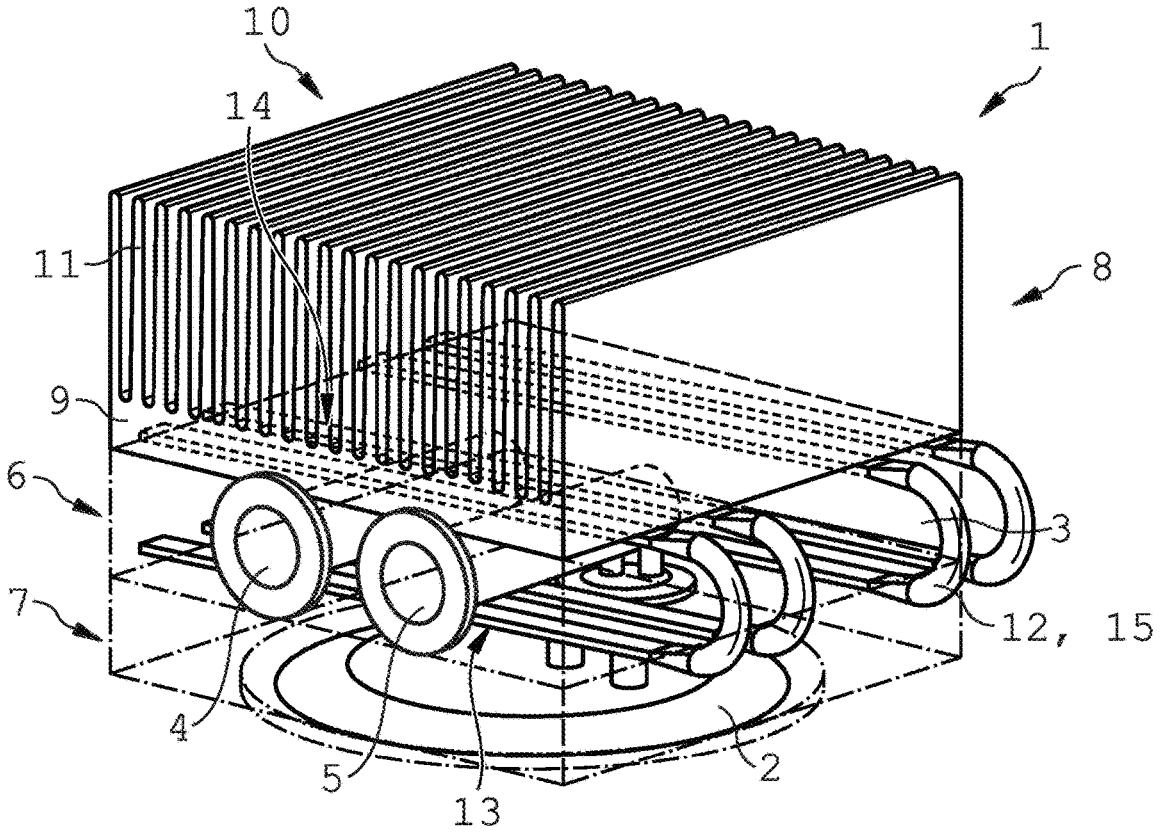
FIG. 16 shows an arrangement of the heat sink contact region in the pressure chamber line region on the contact surface with a heat sink.
Figure 17:
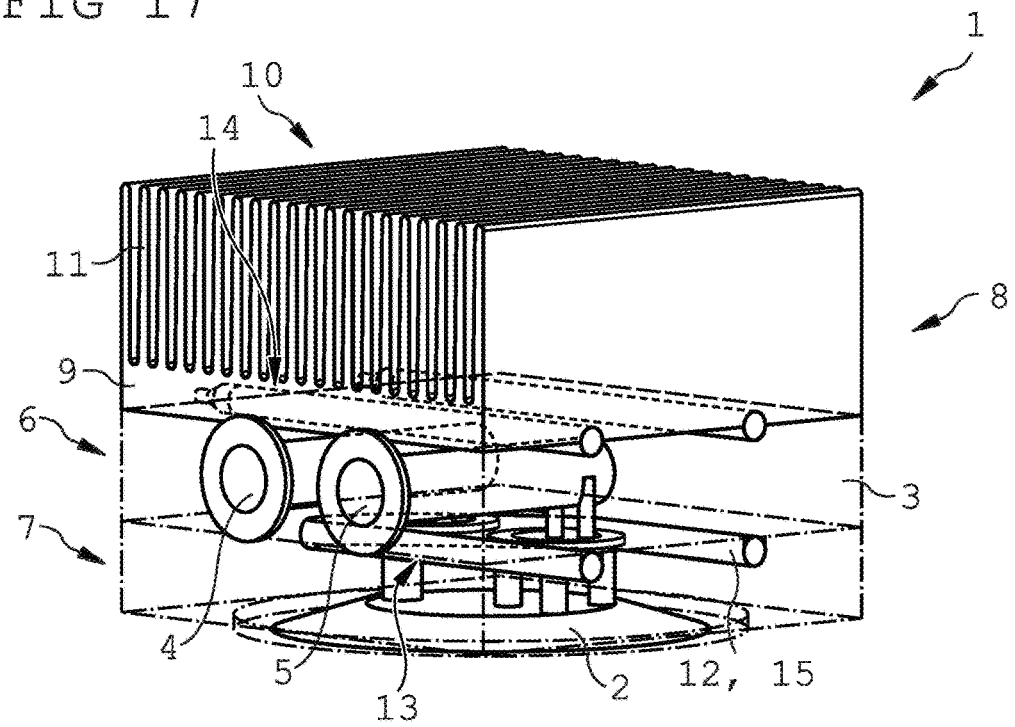
FIG. 17 shows an arrangement of the heat sink contact region between the pressure chamber line region and the heat sink.

FIGS. 11 to 15 each show different configurations of the arrangement of the housing contact region 13 in the housing 3. FIG. 11 shows an arrangement of the housing contact region 13 in the pressure chamber opening region 7 in parallel with the pressure chamber feed line 4 and pressure chamber discharge line 5, while FIG. 12 shows an arrangement in the pressure chamber opening region 7 on a contact surface with the pressure chamber lead-in region 6. FIG. 13 shows the arrangement of the housing contact region 13 between the pressure chamber lead-in region 6 and the pressure chamber opening region 7, and FIG. 14 shows an arrangement in the pressure chamber lead-in region 6 on the contact surface with the pressure chamber opening region 7. FIG. 15 shows a configuration variant in which the housing contact region 13 of the heat pipe 15 is connected to a contact plate 17. In addition, the heat sink contact region 14 also comprises a contact plate 17 connected thereto. The large surface area of a contact plate 17 of this kind allows for effective heat transfer between the housing 3 and the heat pipe 15 or between the heat pipe 15 and the ambient air.

Figure 18:
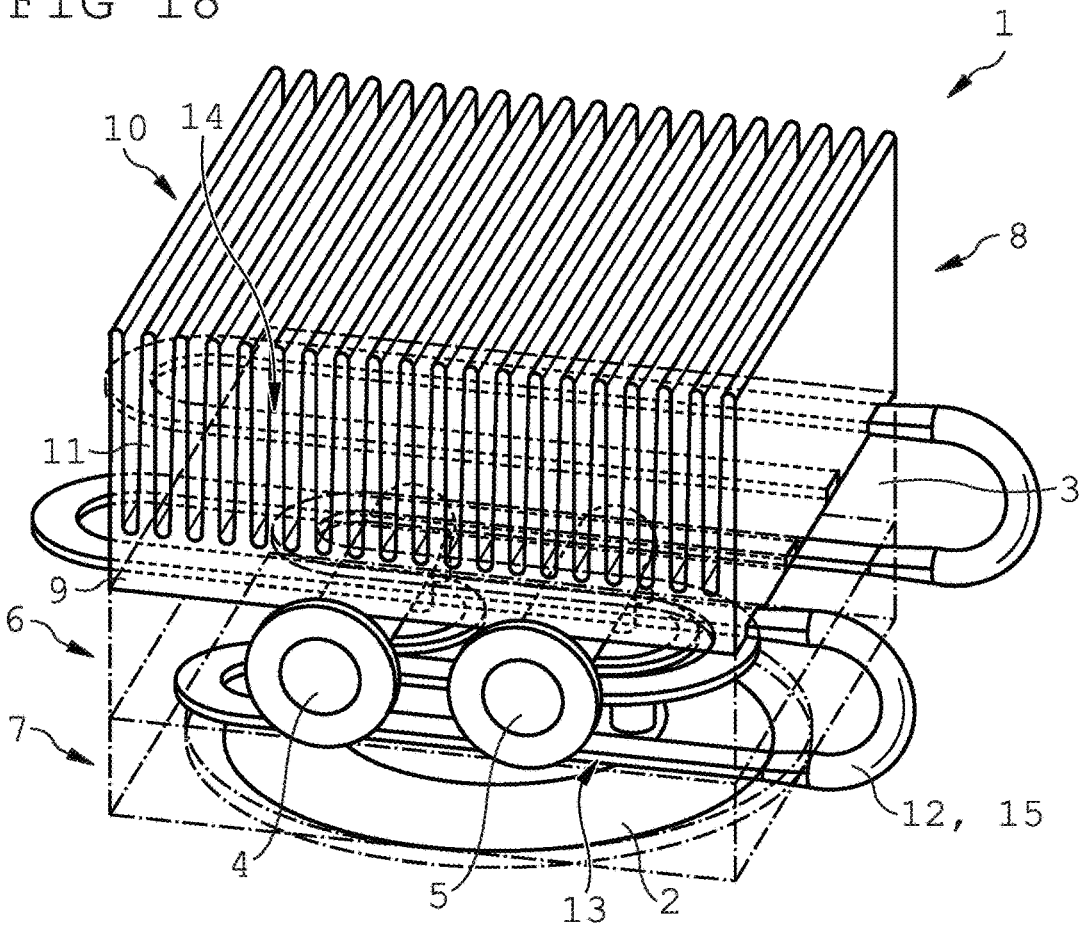
FIG. 18 shows an arrangement of the heat sink contact region in the heat sink on the contact surface with the pressure chamber line region.
Figure 19:
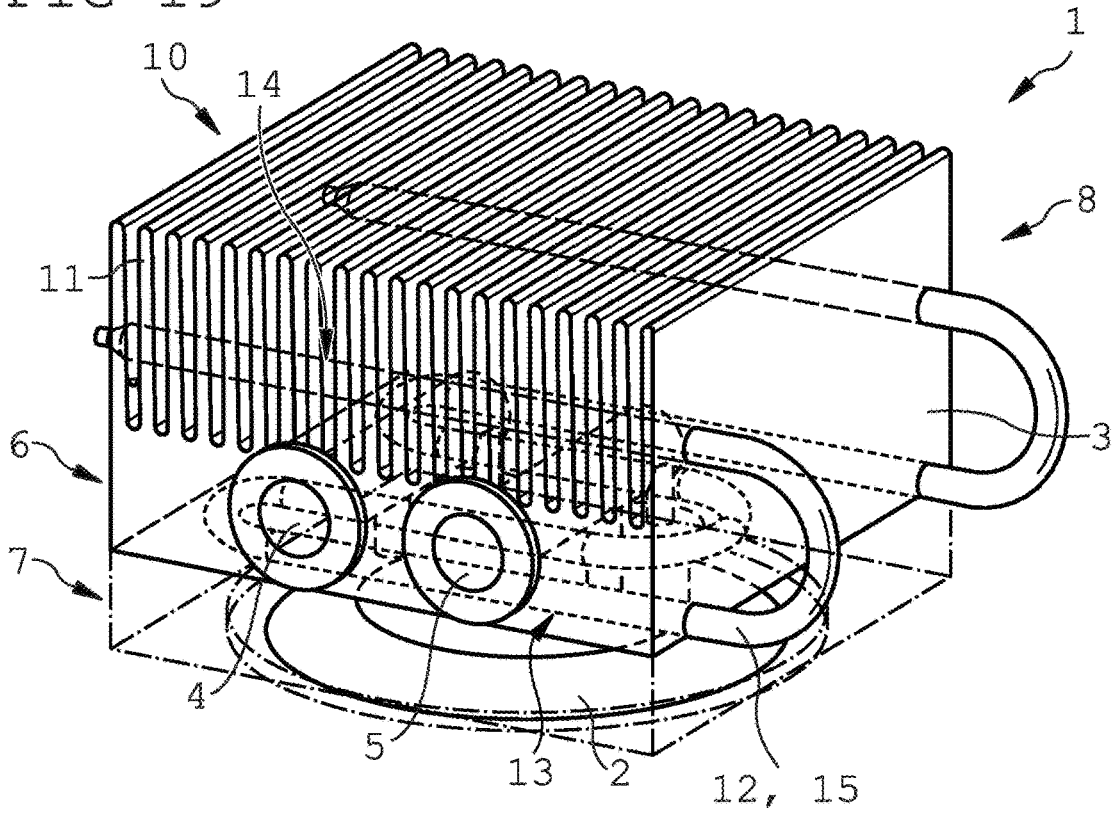
FIG. 19 shows an arrangement of the heat sink contact region in the pressure chamber line region, wherein it is formed integrally with the heat sink.
Figure 20:
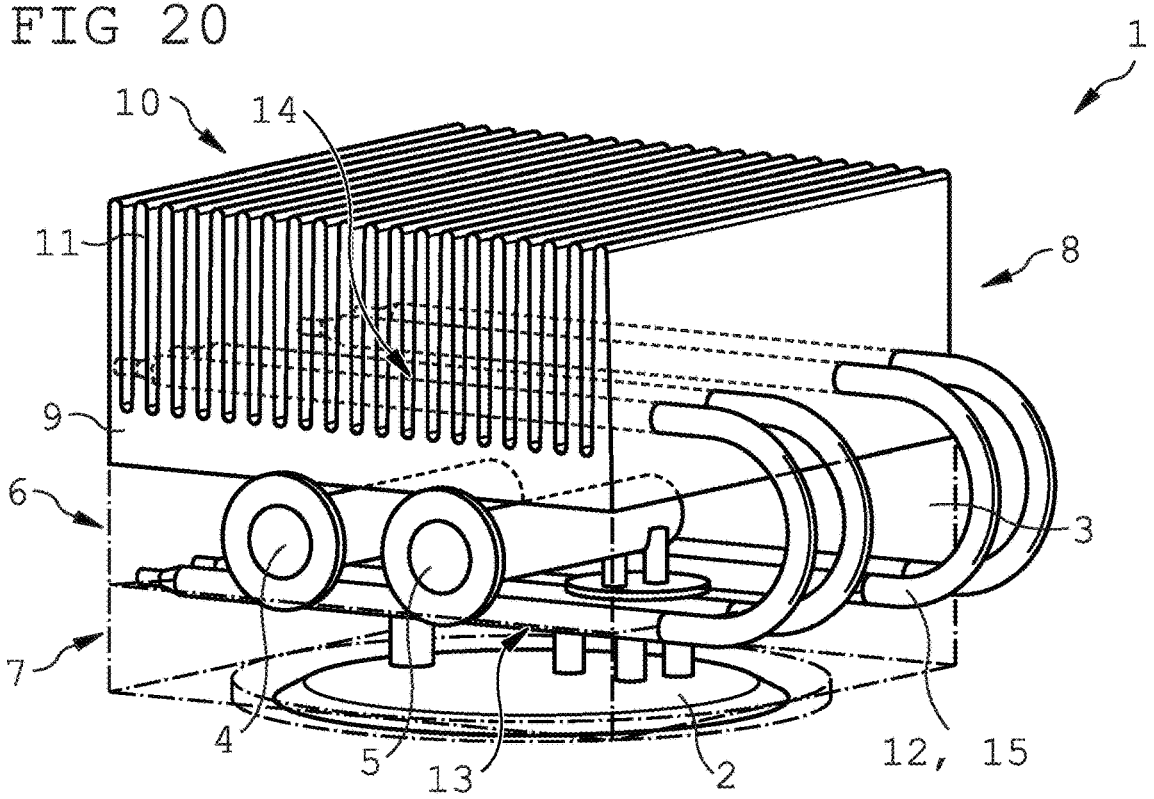
FIG. 20 shows an arrangement of the heat sink contact region in the heat sink.
Figure 21:
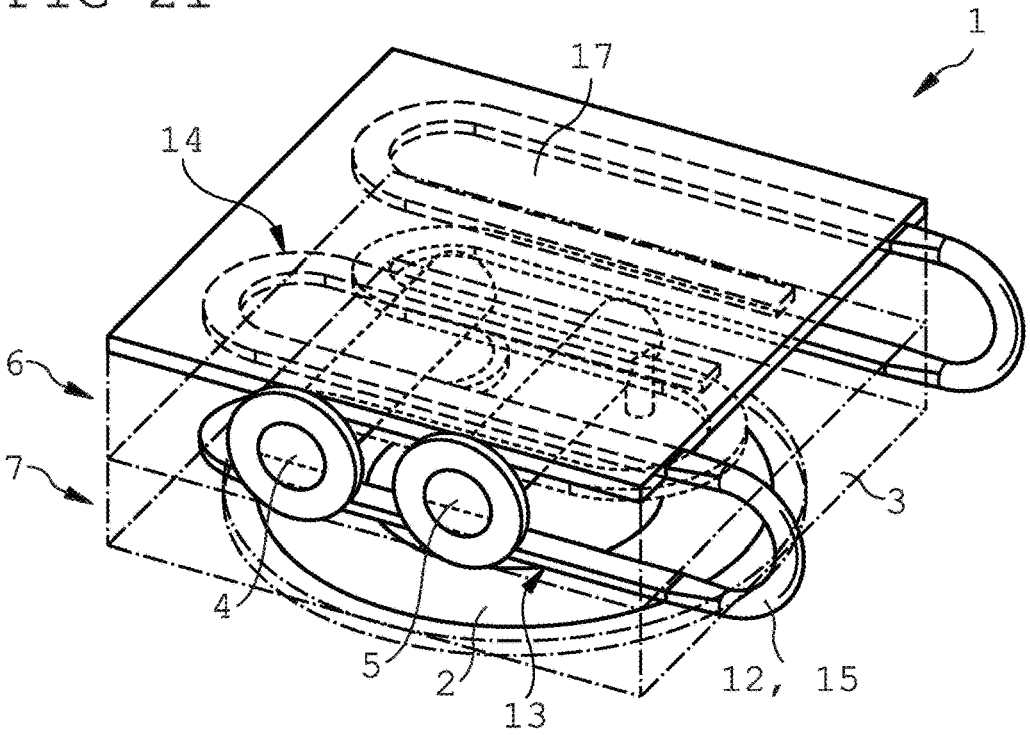
FIG. 21 shows a configuration of the heat sink contact region comprising a contact plate.

FIGS. 16 to 21 each show different configurations of the arrangement of the heat sink contact region 14. In the variant according to FIG. 16, the heat sink contact region 14 of the heat pipes 15 is arranged fully within the pressure chamber lead-in region 6 on a contact surface with the heat sink 8, while, in the variant shown in FIG. 17, the heat sink contact region 14 is arranged between the pressure chamber lead-in region 6 and the heat sink 8. FIG. 18 shows the arrangement of the heat sink contact region 14 in the heat sink 8 in a heat sink cut-out close to the contact surface with the pressure chamber lead-in region 6. In FIG. 19, the cooling fins 11 of the heat sink 8 are formed integrally with the housing 3, wherein the heat sink contact regions 14 are arranged in cut-outs in the cooling fins 11. FIG. 20 likewise shows the arrangement of the heat sink contact regions 14 of the heat pipes 15 in the cooling fins 11, wherein, in this configuration variant, the cooling fins 11 and the heat sink block 9 are arranged on the housing 3. FIG. 21 shows a configuration variant in which the heat sink contact region 14 of the heat pipe 15 is connected to a contact plate 17.

Figure 22:
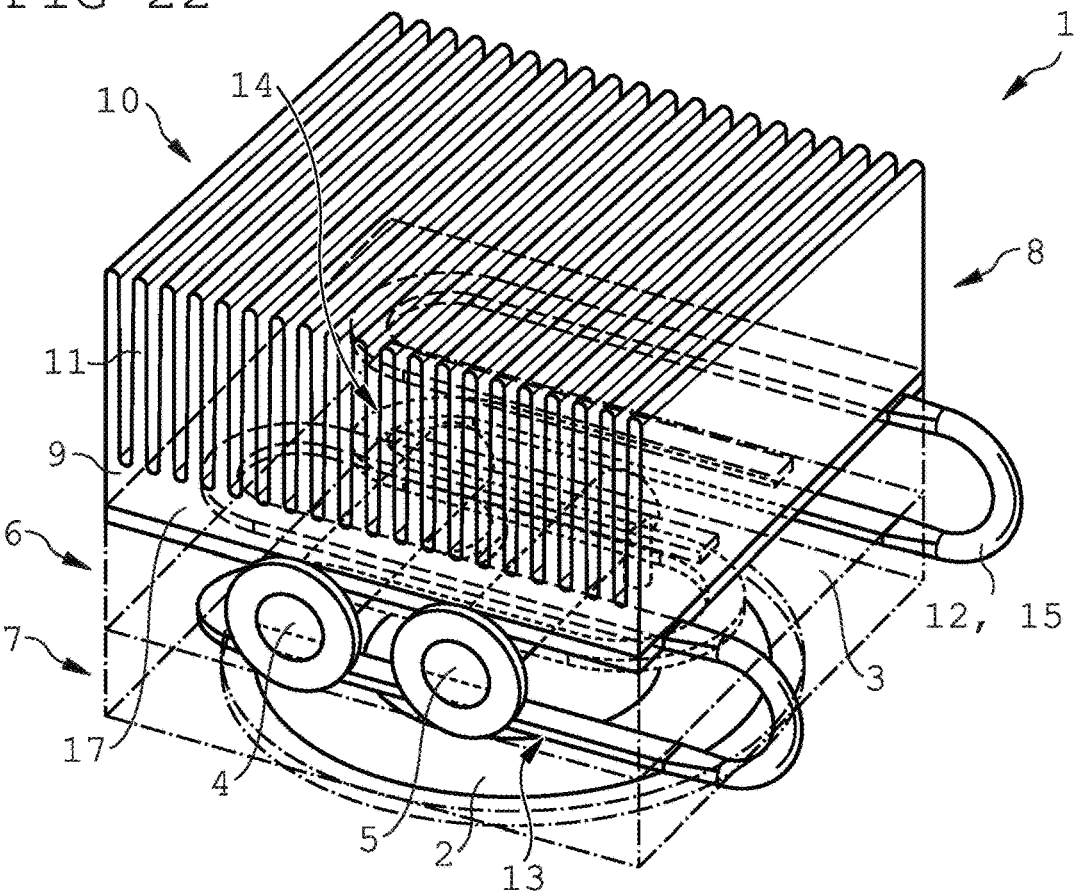
FIG. 22 shows another configuration variant from FIG. 20 comprising a heat sink.
Figure 23:
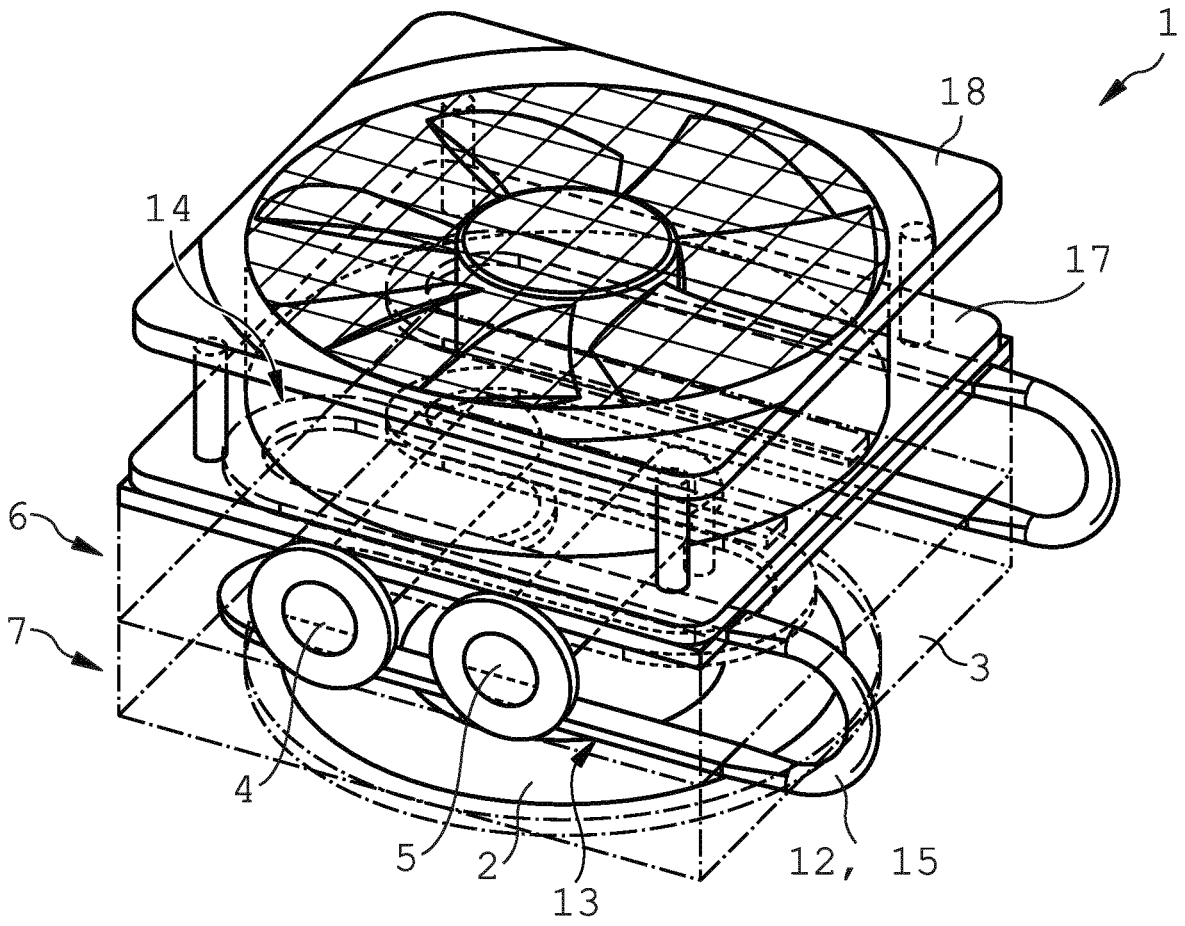
FIG. 23 shows a configuration variant from FIG. 20 comprising an airflow generating device.
Figure 24:
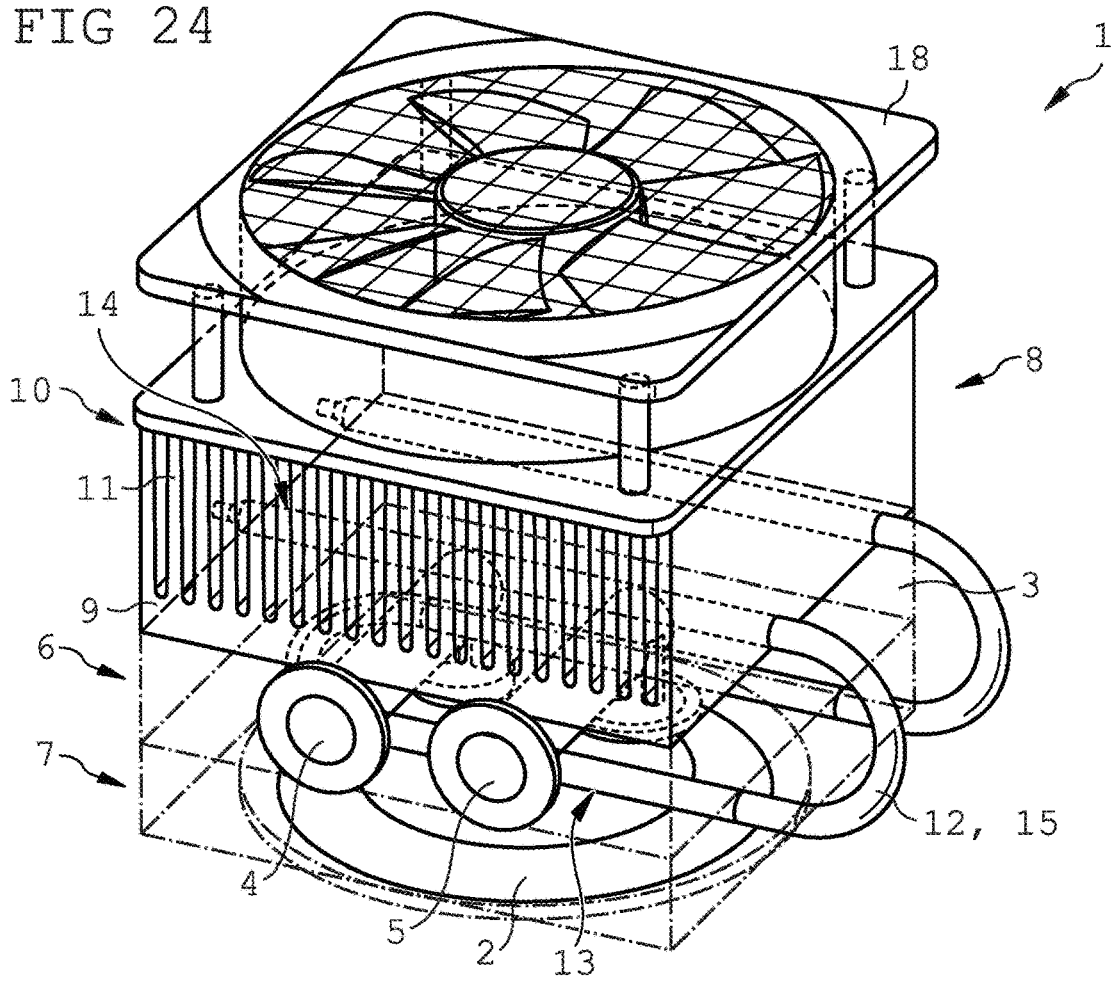
FIG. 24 shows a configuration variant of the pump comprising the heat sink and the airflow generating device arranged thereon.
Figure 25:
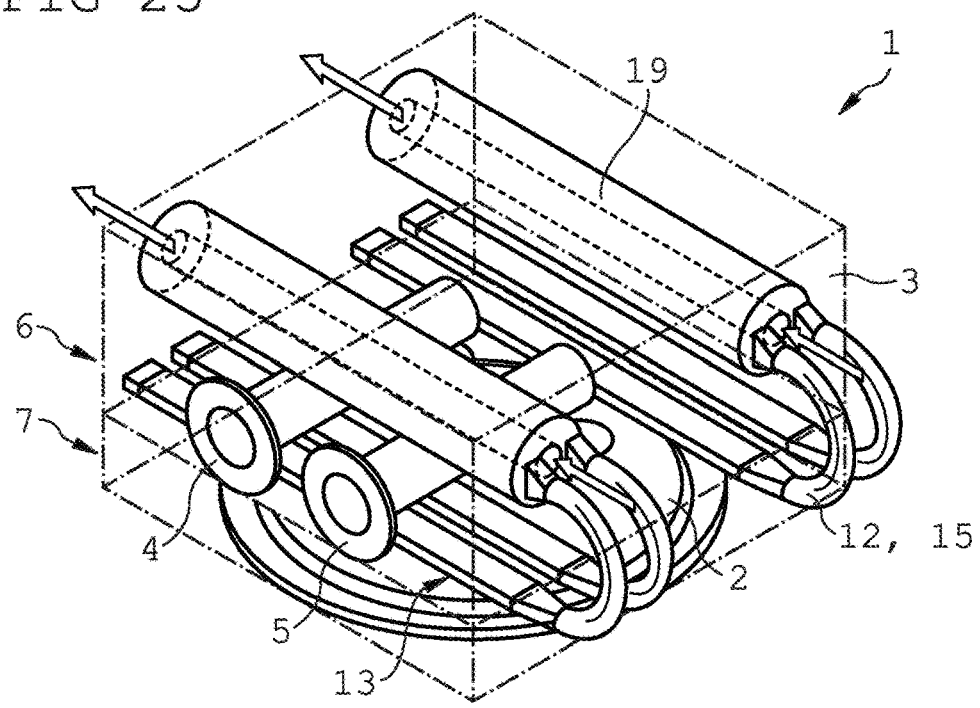
FIG. 25 shows a configuration variant of the heat sink contact region comprising a water-cooling device.

FIGS. 22 to 25 also show further different configuration options of the pump 1 comprising the cooling system in order to further increase the cooling performance. FIG. 22 shows the configuration variant from FIG. 21, wherein the heat sink 8 is arranged on the contact plate 17. FIG. 23 shows a further configuration option from FIG. 21, in which an airflow generating device 18 in the form of a fan is arranged on the contact plate 17. By means of the fan, an air flow can be generated which is directed onto the contact plate 17 for additional cooling. FIG. 24 shows a configuration in which the airflow generating device 18 is arranged on the heat sink 8, wherein the cooling fins 11 are cooled by the generated air flow. FIG. 25 shows a water-cooling device 19 in the form of water-cooling system, which is configured to cool the heat sink contact region 14 of the heat pipe 15.

LIST OF REFERENCE SIGNS

1 Pump
2 Pressure chamber
3 Housing
4 Pressure chamber feed line
5 Pressure chamber discharge line
6 Pressure chamber lead-in region
7 Pressure chamber opening region
8 Heat sink
9 Heat sink block
10 Cooling fin assembly
11 Cooling fins
12 Heat pipes
13 Housing contact region
14 Heat sink contact region
15 Heat pipe
16 Cut-out in the heat pipe
17 Contact plate
18 Airflow generating device
19 Water-cooling device

The invention claimed is:

1. A pump (1), comprising:

a housing (3), which delimits a pressure chamber (2);

a pressure chamber feed line (4) which leads into the pressure chamber (2);

a pressure chamber discharge line (5) which leads out of the pressure chamber (2);

a displacement device arranged displaceably in the pressure chamber (2) for exposing a fluid flowing into the pressure chamber (2) via the pressure chamber feed line (4) to a pressure and expelling the fluid from the pressure chamber (2) via the pressure chamber discharge line (5); and a cooling system for cooling the housing (3) of the pump (1), the cooling system comprising at least one heat pipe (12), containing a heat transfer fluid, and at least one heat sink (8), wherein the at least one heat pipe (12) comprises a housing contact region (13) for providing heat-conducting contact between the at least one heat pipe (12) and the housing (3), and, a heat sink contact region (14) for providing heat-conducting contact between the at least one heat pipe (12) and the at least one heat sink (8), wherein, when the cooling system is used as intended, heat is transferred via the at least one heat pipe (12) from the housing (3) to the at least one heat sink (8), wherein housing contact region (13) is arranged proximal to the pressure chamber feed line (4) and the pressure chamber discharge line (5).

2. The pump (1) according to claim 1, wherein the at least one heat sink (8) comprises a heat sink block (9) and a cooling fin assembly (10) that is connected to the heat sink block (9) for heat conduction and comprises a plurality of cooling fins (11) arranged at a distance from one another, wherein heat absorbed by the heat sink block (9) is emitted to ambient air via the cooling fins (11), and wherein the pressure chamber feed line (4) and the pressure chamber discharge line (5) extend between the heat sink block (9) and the pressure chamber (2).

3. The pump (1) according to claim 2, wherein an airflow generating device (18) is arranged on the at least one heat sink (8), and wherein an air flow can be generated by the airflow generating device (18) for additional cooling of the cooling fins (11).

4. The pump (1) according to claim 1, wherein the cooling system comprises a water-cooling device (19) for cooling the heat sink contact region (13) of the at least one heat pipe (12).

5. The pump (1) according to claim 2, wherein the at least one heat pipe (12) is arranged in heat sink cut-outs in the heat sink block (9) by the heat sink contact region (14) and is connected to the heat sink block (9) for heat conduction, and wherein the at least one heat pipe (12) includes a U-shaped portion between the heat sink block (9) and the housing (3).

6. The pump (1) according to claim 3, wherein the heat sink contact region (14) of the at least one heat pipe (12) is connected to a contact plate (17) for heat conduction, and wherein the contact plate (17) can be cooled by the airflow generating device (18) or is connected to the at least one heat sink (8).

7. The pump (1) according to claim 2, wherein the plurality of cooling fins (11) are arranged in parallel with a surface of the housing (3).

8. The pump (1) according to claim 2, wherein the plurality of cooling fins (11) are arranged at an angle to a surface of the housing (3).

9. The pump (1) according to claim 2, wherein the pressure chamber feed line (4) and/or the pressure chamber discharge line (5) are embedded in the heat sink block (9).

10. The pump (1) according to claim 1, wherein the pressure chamber feed line (4) and the pressure chamber discharge line (5) each include a lead-in region (6) that extends in parallel with an adjacent surface of the pressure chamber (2), and a pressure chamber opening region (7) substantially perpendicular to the adjacent surface of the pressure chamber (2).

11. The pump (1) according to claim 2, wherein the at least one heat pipe (12) has a meandering course.

12. The pump (1) according to claim 1, wherein the at least one heat pipe (12) comprises at least two heat pipes (12).

13. The pump (1) according to claim 1, wherein the housing contact region (13) of the at least one heat pipe (12) is arranged in parallel with the pressure chamber feed line (4) and/or the pressure chamber discharge line (5).

14. The pump (1) according to claim 1, wherein the housing contact region (13) of the at least one heat pipe (12) is arranged between the pressure chamber feed line (4) and/or the pressure chamber discharge line (5) and the pressure chamber (2).

15. The pump (1) according to claim 1, wherein the pump (1) is a membrane pump.

* * * * *